US009962946B2

(12) United States Patent
Kanaya et al.

(10) Patent No.: US 9,962,946 B2
(45) Date of Patent: May 8, 2018

(54) LIQUID EJECTING SYSTEM

(71) Applicant: SEIKO EPSON CORPORATION, Tokyo (JP)

(72) Inventors: Munehide Kanaya, Azumino (JP); Tokujiro Okuno, Kitakyushu (JP); Hideo Shimamura, Santa Clara, CA (US)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/509,454

(22) PCT Filed: Sep. 4, 2015

(86) PCT No.: PCT/JP2015/004507
§ 371 (c)(1),
(2) Date: Mar. 7, 2017

(87) PCT Pub. No.: WO2016/038863
PCT Pub. Date: Mar. 17, 2016

(65) Prior Publication Data

US 2017/0274663 A1 Sep. 28, 2017

(30) Foreign Application Priority Data

Sep. 8, 2014 (JP) ..... 2014-182012

(51) Int. Cl.
*B41J 2/175* (2006.01)

(52) U.S. Cl.
CPC ..... *B41J 2/17506* (2013.01); *B41J 2/1752* (2013.01); *B41J 2/17566* (2013.01); *B41J 2/17553* (2013.01)

(58) Field of Classification Search
CPC .. B41J 2/17506; B41J 2/17566; B41J 2/1752; B41J 2/17553
See application file for complete search history.

(56) References Cited

U.S. PATENT DOCUMENTS 5,434,603 A * 7/1995 Hunt ..... B41J 2/17506 222/23
5,689,290 A * 11/1997 Saito ..... B41J 2/17513 250/577
6,293,143 B1 * 9/2001 Denton ..... B41J 2/17566 250/227.11
2005/0078156 A1 * 4/2005 Lee ..... B41J 2/17506 347/86

(Continued)

FOREIGN PATENT DOCUMENTS

CN 102371771 A 3/2012
JP 2012-051328 A 3/2012

(Continued)

OTHER PUBLICATIONS

International Search Report dated Dec. 1, 2015 in PCT/JP2015/004507 with English-language translation (4 pgs.).

*Primary Examiner* — Julian Huffman
(74) *Attorney, Agent, or Firm* — Foley & Lardner LLP

(57) ABSTRACT

A liquid ejecting system has a liquid ejecting apparatus, a liquid storing container, and a conduit. When the liquid storing container is pulled out from the case of the liquid ejecting apparatus, the visual recognition portion provided on the liquid storing container is exposed from the case.

15 Claims, 11 Drawing Sheets

(56) References Cited

U.S. PATENT DOCUMENTS

| | | | | |
|---|---|---|---|---|
| 2009/0179926 | A1* | 7/2009 | Sugahara | B41J 2/17566 347/7 |
| 2009/0219310 | A1* | 9/2009 | Kondo | B41J 2/17566 347/7 |
| 2010/0141716 | A1* | 6/2010 | Kanesaka | B41J 2/17513 347/86 |
| 2010/0245502 | A1* | 9/2010 | Kanbe | B41J 2/1752 347/86 |
| 2012/0044285 | A1 | 2/2012 | Ogasawara et al. | |
| 2013/0162734 | A1* | 6/2013 | Norikane | B41J 2/1752 347/86 |
| 2013/0258006 | A1 | 10/2013 | Kato | |
| 2015/0109388 | A1 | 4/2015 | Okuno et al. | |
| 2016/0016409 | A1* | 1/2016 | Kimura | B41J 2/17523 347/86 |

FOREIGN PATENT DOCUMENTS

| | | | |
|---|---|---|---|
| JP | 2013-208740 | A | 10/2013 |
| JP | 2015-080908 | A | 4/2015 |

* cited by examiner

LIQUID EJECTING SYSTEM

TECHNICAL FIELD

The present invention relates to a liquid ejecting system provided with a liquid storing container for containing a liquid and a liquid ejecting apparatus for ejecting a liquid supplied from the liquid storing container.

BACKGROUND ART

Conventionally, a liquid ejecting system provided with a liquid ejecting apparatus provided with a liquid ejecting unit for ejecting a liquid such as ink, and a liquid storing container for supplying a liquid to the liquid ejecting unit is used. Patent Literature 1 discloses an example of a liquid ejecting system of this type. In Patent Literature 1, a tank case that houses an ink tank is mounted on a side face of an inkjet printer, which is an example of a liquid ejecting apparatus. A checking window is provided in a side face of the tank case (the side face on the side opposite to the side on which the inkjet printer is arranged). When refilling the ink tank with ink, the tank case is removed from the inkjet printer, and the tank unit is turned over so as to be in a refill orientation in which an injection port of the ink tank is directed upward. After the ink is injected, the tank unit is returned to the original orientation and is mounted to the inkjet printer.

CITATION LIST

Patent Literature

Patent Literature 1: JP-A-2012-051328

SUMMARY OF INVENTION

Technical Problem

In JP-A-2012-051328, a checking window for checking the amount of ink in the ink tank is provided in the side face on the side opposite to the side on which the inkjet printer is arranged, out of the side faces of the tank unit. Therefore, in the case where the width of the inkjet printer is large, it is necessary to perform operations such as the user moving to outward of the liquid ejecting system in the width direction in order to inject ink, and observing through the checking window to check the ink amount. Therefore, the work load of the user is heavy.

The invention has been made in order to solve such an issue, and aims to propose a liquid ejecting system that makes it easy for the user to perform operations on a liquid storing container.

Solution to Problem

In order to solve the above-described issue, a liquid ejecting system of the invention includes: a liquid ejecting apparatus capable of ejecting a liquid; a liquid storing container capable of containing the liquid; and a conduit that connects the liquid ejecting apparatus and the liquid storing container and is capable of supplying the liquid from the liquid storing container to the liquid ejecting apparatus, wherein out of outer walls of the liquid storing container, a first face directed in a first direction from the liquid storing container toward the liquid ejecting apparatus is relatively movable with respect to a second face directed in a second direction from the liquid ejecting apparatus toward the liquid storing container, out of the outer walls of the liquid ejecting apparatus, from a first position to a second position that is different from the first position, and a visual recognition portion through which the interior of the liquid storing container is visually recognizable (when the first face is) at the second position is provided in the first face of the liquid storing container.

According to the invention, by moving the liquid storing container, the first face facing the liquid ejecting apparatus can be moved from the first position to the second position, and this operation makes it possible to visually recognize the interior of the liquid storing container from the visual recognition portion formed in the first face of the liquid storing container. With such a configuration, when checking the interior of the liquid storing container, observation can be performed through the visual recognition portion of the liquid storing container from the liquid ejecting apparatus side, and it is not necessary to perform the operation of observing the liquid storing container from the side opposite to the liquid ejecting apparatus. Therefore, it is possible to make it easy to perform operations on the liquid storing container. For example, it is possible to reduce the workload when checking the amount of the liquid in the liquid storing container.

In the invention, it is desirable that, when the first face is at the first position, the visual recognition portion faces the liquid ejecting apparatus, and when the first face is at the second position, the visual recognition portion does not face the liquid ejecting apparatus. As a result, by moving the liquid storing container, it is possible to switch between a state where the visual recognition portion is visually recognizable and a state where the visual recognition portion is not visually recognizable.

In the invention, it is desirable that a third direction in which the first face moves from the first position toward the second position intersects the first direction or the second direction, the liquid storing container has a first liquid storing portion having a first liquid injection port and a second liquid storing portion having a second liquid injection port and having a larger volume than the first liquid storing portion, the first liquid storing portion is positioned on a third direction side of the second liquid storing portion, and when a direction opposite to the third direction is assumed to be a fourth direction, the second liquid injection port is provided at a position closer to a third face directed in the third direction of the second liquid storing portion than to a fourth face directed in the fourth direction of the second liquid storing portion. As a result, when arranging liquid storing portions having different volumes, the liquid injection ports can be arranged in a group on the side where the liquid storing portion volume is small. By arranging the liquid injection ports in a group, it is possible to improve the operation efficiency of the operation of injecting a liquid into the liquid storing portions.

In this case, it is desirable that the visual recognition portions include a first visual recognition window through which the first liquid storing portion is visually recognizable and a second visual recognition window through which the second liquid storing portion is visually recognizable, and the second visual recognition window is provided at a position closer to the third face than to the fourth face of the second liquid storing portion. As a result, a plurality of visual recognition windows can be arranged in a group on the side where the liquid storing portion volume is small. By arranging the visual recognition portions in a group, it is possible to improve the operation efficiency of the operation of checking the liquid amounts of a plurality of liquid storing portions.

Alternatively, in the invention, it is desirable that a third direction in which the liquid storing container moves from the first position toward the second position intersects the first direction or the second direction, the liquid storing container includes a first liquid storing portion having a first liquid injection port and a second liquid storing portion having a second liquid injection port and having a larger volume than the first liquid storing portion, the first liquid storing portion is positioned on the third direction side of the second liquid storing portion, the visual recognition portion includes a first visual recognition window through which the first liquid storing portion is visually recognizable and a second visual recognition window through which the second liquid storing portion is visually recognizable, and when a direction opposite to the third direction is assumed to be a fourth direction, the second visual recognition window is provided at a position closer to a third face directed in the third direction of the second liquid storing portion than to a fourth face directed in the fourth direction of the second liquid storing portion. As a result, a plurality of visual recognition windows can be arranged in a group on a liquid storing portion side having a smaller volume. By arranging the visual recognition portions in a group, it is possible to improve the operation efficiency of the operation of checking the liquid amounts of a plurality of liquid storing portions.

In the invention, it is desirable that a liquid ejecting apparatus-side engagement portion is provided on the second face of the liquid ejecting apparatus, a liquid storing container-side engagement portion is provided on the first face of the liquid storing container, and the liquid ejecting apparatus-side engagement portion and the liquid storing container-side engagement portion engage with each other such that the liquid storing container can slide and move relative to the liquid ejecting apparatus. As a result, the liquid storing container can be slid and pulled out to the operator side. Therefore, the operation of moving the liquid storing container in order to check the liquid amount is easy. In addition, even in the case where the liquid ejecting system is installed in a limited space, the liquid storing container can be easily moved to a position at which the liquid amount can be checked.

In the invention, it is desirable that a bottom face of the liquid ejecting apparatus has an extending portion, the liquid storing container is placed on the extending portion, the first face is a face directed to the liquid storing container on the extending portion, a liquid ejecting apparatus-side engagement portion is provided on the first face, the second face is a face directed to the extending portion of the liquid storing container, a liquid storing container-side engagement portion is provided on the second face, and the liquid ejecting apparatus-side engagement portion and the liquid storing container-side engagement portion engage with each other such that the liquid ejecting apparatus can slide and move relative to the liquid storing container. In this manner, in the case where the extending portion is provided and the liquid storing container is placed on the extending portion, a slide type engagement portion can be provided between the extending portion and the liquid storing container. Therefore, by sliding the liquid storing container and pulling it out toward the operator side, it is possible to easily perform the operation of moving the liquid storing container in order to check the liquid amount. Moreover, even in the case where the liquid ejecting system is installed in a limited space, the liquid storing container can be moved easily.

In the invention, it is desirable that an apparatus-side conduit opening portion extending in a direction from the first position toward the second position is provided in the second face of the liquid ejecting apparatus, a container-side conduit opening portion extending in a direction from the first position toward the second position is provided in the first face of the liquid storing container, and the conduit communicates with the interior of the liquid ejecting apparatus via the apparatus-side conduit opening portion, and communicates with the interior of the liquid storing container via the container-side conduit opening portion. In this manner, if the conduit is arranged so as to pass through openings formed in opposing faces of the liquid ejecting apparatus and the liquid storing container, the conduit can be routed along a simple route. Moreover, it is possible to reduce exposure of the conduit to the outside.

In the invention, it is desirable that in a planar view of the liquid ejecting system from the first direction, at least a portion of the apparatus-side conduit opening portion and at least a portion of the container-side conduit opening portion overlap each other at both the first position and the second position. If, in this manner, the connection state of the conduit can be maintained in both cases where the liquid storing container is at the position of one end (first position) and at the position of the other end (second position) of the moving range of the liquid storing container, the connection state of the conduit can be maintained even if the liquid storing container moves.

In the invention, it is desirable that the liquid storing container has a residual amount detecting unit capable of detecting a residual amount of a liquid contained in the liquid storing container, and when the first face of the liquid storing container is arranged at the second position, an amount of a liquid contained in the liquid storing container can be observed using the visual recognition portion, and when the first face of the liquid storing container is arranged at the first position, the amount of the liquid contained in the liquid storing container can be detected using the residual amount detecting unit. As a result, when the liquid storing container is pulled out to pour a liquid therein, injection can be performed while checking the liquid amount using the visual recognition portion, and in a state where liquid injecting work is finished and the liquid storing container is returned to the original position, the liquid residual amount can be detected using the residual amount detecting unit.

In the invention, it is desirable that a wiring that is connected to the residual amount detecting unit is provided, an apparatus-side wiring opening portion extending in a direction from the first position toward the second position is provided in the second face of the liquid ejecting apparatus, a container-side wiring opening portion extending in a direction from the first position toward the second position is provided in the first face of the liquid storing container, and the wiring is connected to the interior of the liquid ejecting apparatus via the apparatus-side wiring opening portion, and is connected to the interior of the liquid storing container via the container-side wiring opening portion. As a result, the wiring can be routed along a simple route. Moreover, it is possible to reduce the exposure of the wiring to the outside.

In the invention, it is desirable that, in a planar view of the liquid ejecting system from the first direction, at least a portion of the apparatus-side wiring opening portion and at least a portion of the container-side wiring opening portion overlap each other in both states of the first position and the second position. If, in this manner, the connection state of the wiring can be maintained in both cases where the liquid storing container is at the position of one end (first position) and at the position of the other end (second position) of the moving range of the liquid storing container, the connection state of the wiring can be maintained even if the liquid storing container moves.

Next, the invention includes: a liquid ejecting apparatus capable of ejecting a liquid; a liquid storing container that is positioned in the liquid ejecting apparatus, and is capable of containing the liquid; and a conduit that connects the liquid ejecting apparatus and the liquid storing container, and is capable of supplying the liquid from the liquid storing container to the liquid ejecting apparatus, wherein a configuration is also possible in which out of outer walls of the liquid storing container, out of faces facing inner walls of the liquid ejecting apparatus, a first face directed in a first direction is relatively movable from a first position to a second position that is different from the first position, with respect to a second face directed in a second direction opposite to the first direction, out of inner walls of the liquid ejecting apparatus, out of faces facing the outer walls of the liquid storing container, and a visual recognition portion through which an interior of the liquid storing container is visually recognizable when the first face is at the second position is provided in a third face that is on a side opposite to the first face of the liquid storing container.

In this manner, in the invention, by moving the liquid storing container incorporated in the liquid ejecting apparatus, the first face, which is a face of the liquid storing container that faces the liquid ejecting apparatus, can be relatively moved with respect to the second face of the liquid ejecting apparatus, and this operation enables visual recognition of the interior of the liquid storing container from the visual recognition portion formed in the third face of the liquid storing container. With such a configuration, when checking the interior of the liquid storing container, observation through the visual recognition portion of the liquid storing container is possible from inward of the liquid ejecting apparatus in the width direction, and it is not necessary to perform the operation of observing the liquid storing container from outward of the liquid ejecting apparatus in the width direction. Therefore, operations on the liquid storing container can be made easy. For example, it is possible to reduce the workload when checking the amount of liquid in the liquid storing container.

In the invention, it is desirable that when the first face is at the first position, the visual recognition portion faces the liquid ejecting apparatus, and when the first face is at the second position, the visual recognition portion does not face the liquid ejecting apparatus. As a result, by moving the liquid storing container, it is possible to switch between a state where visual recognition through the visual recognition portion is possible and a state where visual recognition through the visual recognition is not possible.

In the invention, it is desirable that a third direction in which the first face moves from the first position to the second position intersects the first direction or the second direction, the liquid storing container includes a first liquid storing portion having a first liquid injection port and a second liquid storing portion having a second liquid injection port and having a larger volume than the first liquid storing portion, the first liquid storing portion is positioned on a third direction side of the second liquid storing portion, and when a direction opposite to the third direction is assumed to be a fourth direction, the second liquid injection port is provided at a position closer to a third face directed in the third direction of the second liquid storing portion than to a fourth face directed in the fourth direction of the second liquid storing portion. As a result, when aligning the liquid storing portions having different volumes side by side, the liquid injection ports can be arranged in a group on the side where the liquid storing portion volume is small. By arranging the liquid injection ports in a group, it is possible to improve the operation efficiency of the operation of injecting liquids into the liquid storing portions.

In this case, it is desirable that the visual recognition portions include a first visual recognition window through which the first liquid storing portion is visually recognizable and a second visual recognition window through which the second liquid storing portion is visually recognizable, and the second visual recognition window is provided at a position closer to the third face than to the fourth face of the second liquid storing portion. As a result, a plurality of visual recognition windows can be arranged in a group on the side where the liquid storing portion volume is small. By arranging the visual recognition portions in a group, it is possible to improve the operation efficiency of the operation of checking liquid amounts of a plurality of liquid storing portions.

Alternatively, in the invention, it is desirable that a third direction in which the liquid storing container moves from the first position to the second position intersects the first direction or the second direction, the liquid storing container includes a first liquid storing portion having a first liquid injection port and a second liquid storing portion having a second liquid injection port and having a larger volume than the first liquid storing portion, the first liquid storing portion is positioned on a third side of the second liquid storing portion, the visual recognition portions include a first visual recognition window through which the first liquid storing portion is visually recognizable and a second visual recognition window through which the second liquid storing portion is visually recognizable, and when a direction opposite to the third direction is assumed to be a fourth direction, the second visual recognition window is provided at a position closer to a third face directed in the third direction of the second liquid storing portion than to a fourth face directed in the fourth direction of the second liquid storing portion. As a result, a plurality of visual recognition windows can be arranged in a group on the side where the liquid storing portion volume is small. By arranging the visual recognition portions in a group, it is possible to improve the operation efficiency of the operation of checking the amounts of liquid of a plurality of liquid storing portions.

DESCRIPTION OF EMBODIMENTS

Embodiments of a liquid ejecting system to which the invention is applied will be described below with reference to the drawings.

First Embodiment

Figure 1A:
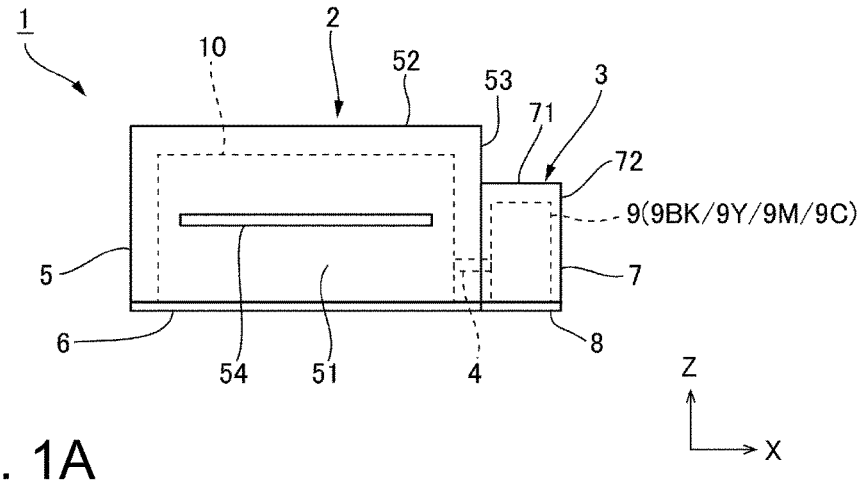
FIGS. 1A and 1B are explanatory diagrams (a front view and an exploded perspective view) schematically showing a liquid ejecting system according to a first embodiment of the invention.
Figure 1B:
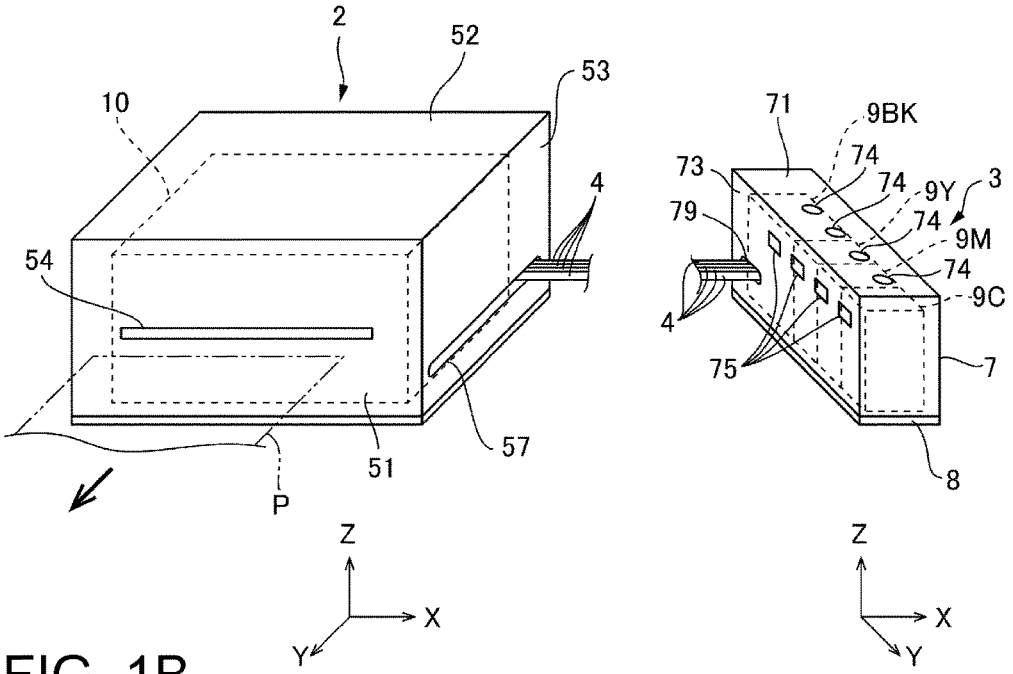
Figure 2A:
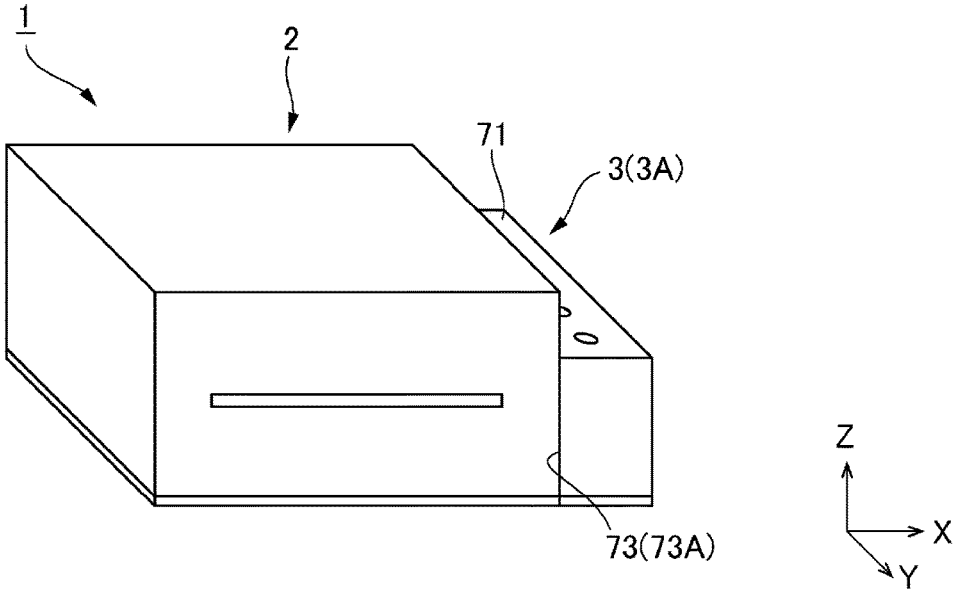
FIGS. 2A and 2B are explanatory diagrams showing a first position and a second position of a tank unit.
Figure 2B:
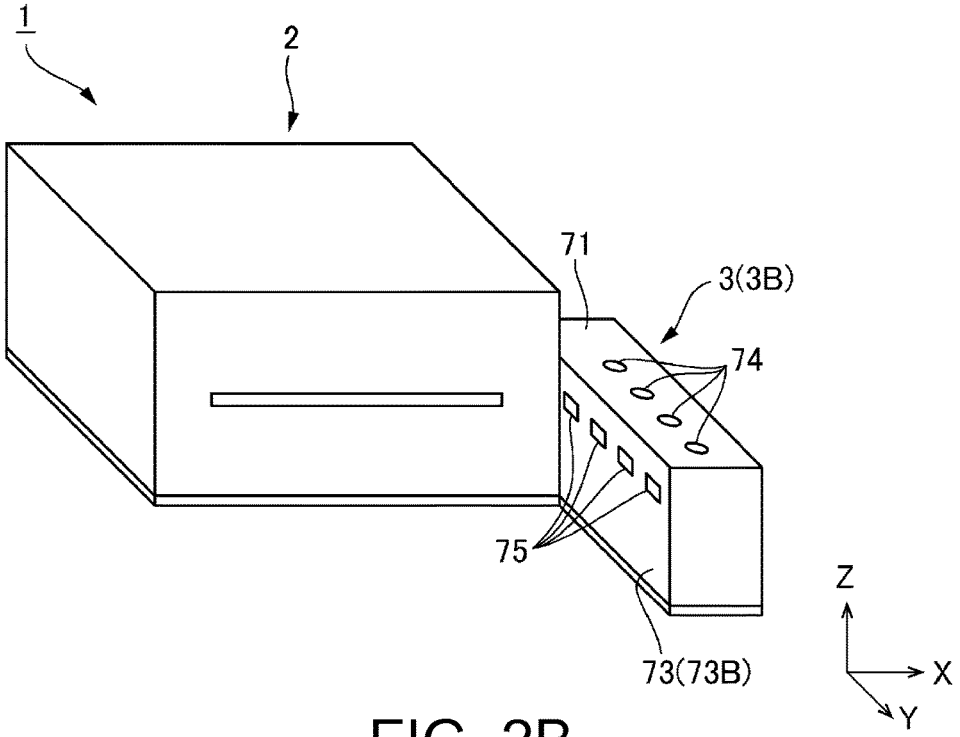

FIG. 1 includes explanatory diagrams schematically showing a liquid ejecting system according to a first embodiment of the invention, where FIG. 1(*a*) is a front view of the liquid ejecting system, and FIG. 1(*b*) is an exploded perspective view of the liquid ejecting system. Also, FIG. 2 includes explanatory diagrams showing a first position and a second position of a tank unit, where FIG. 2(*a*) shows a state where the tank unit and a printer are arranged side by side (first position), and FIG. 2(*b*) shows a state where the tank unit is pulled out forward relative to the printer (second position). In FIGS. 1 and 2, X, Y and Z axes, which are coordinate axes intersecting each other, are added. Also in the figures shown hereinafter, X, Y and Z axes are added as necessary. Regarding each of the X, Y and Z axes, the direction of the arrow indicates a + (positive) direction, and the direction opposite to the direction of the arrow indicates a − (negative) direction. In a state where a liquid ejecting system 1 is used, the liquid ejecting system 1 is arranged on the XY plane, which is the horizontal plane. In a usage state of the liquid ejecting system 1, the Z axis is directed in the vertical direction, and the −Z direction is downward in the vertical direction.

As shown in FIGS. 1(*a*) and 1(*b*), the liquid ejecting system 1 of the first embodiment has a printer 2, which is an example of a liquid ejecting apparatus, a tank unit 3, which is an example of a liquid storing container, and a supply tube 4, which is an example of a liquid supply tube. Ink, which is an example of a liquid, is reserved in the tank unit 3. The printer 2 is an inkjet printer. In the liquid ejecting system 1, a printing medium P such as printing paper is conveyed to the printer 2, the ink is supplied from the tank unit 3 to the printer 2 via the supply tube 4, and printing is performed onto the printing medium P. The tank unit 3 is arranged on the +X direction side relative to the printer 2, and can slide in the Y axis direction relative to the printer 2. The tank unit 3 is usually positioned at a first position 3A at which the tank unit 3 is aligned with the printer 2 in the X axis direction, as shown in FIG. 2(*a*). In this state, a printing operation and the like of the printer 2 are performed. In addition, the tank unit 3 is pulled out to a second position 3(*b*) that is on the front side (the +Y direction side) relative to the printer 2, as shown in FIG. 2(*b*). In this state, checking of the amount of ink in the tank unit 3 and the like can be performed.

The printer 2 is provided with an upper case 5, a lower case 6 and a mechanism unit 10. The upper case 5 opposes the lower case 6 in the Z axis direction. The mechanism unit 10 is housed between the upper case 5 and the lower case 6. The mechanism unit 10 is a mechanism part for executing a printing operation. The upper case 5 is provided with a front face 51 directed in the +Y direction, an upper face 52 directed in the +Z direction (upward in the vertical direction) and a side face 53 (second face) directed in the +X direction (second direction). The front face 51 is provided with a paper discharge unit 54 for discharging the printing medium P.

The mechanism unit 10 of the printer 2 is supported by the lower case 6. The mechanism unit 10 is provided with a printing head (not illustrated), a head movement mechanism (not illustrated), a medium conveyance mechanism (not illustrated) and the like. The head movement mechanism is provided with a carriage (not illustrated) to which the printing head is mounted. The head movement mechanism moves the carriage in the X axis direction by transmitting motive power from a motor to the carriage via a timing belt or the like. The medium conveyance mechanism conveys the printing medium P in the Y axis direction by driving a conveyance roller using motive power from the motor. The carriage is provided with a relay unit to which one end of the supply tube 4 is connected. The printing head is connected to the supply tube 4 via the relay unit. The supply tube 4 has flexibility. The printing head is an inkjet head, and discharges, as ink droplets, ink supplied from the tank unit 3 via the relay unit and the supply tube 4. The printer 2 performs printing on the printing medium P by discharging ink droplets from the printing head while changing the relative position of the printing head with respect to the printing medium P using the medium conveyance mechanism and the head movement mechanism.

The tank unit 3 is provided with an over-tank case 7, an under-tank case 8 and tanks 9, which are examples of a liquid storing portion. The over-tank case 7 opposes the under-tank case 8 in the Z axis direction. The tanks 9 are housed between the over-tank case 7 and the under-tank case 8. The tanks 9 contain ink used for printing. One tank 9Bk that contains black ink, one tank 9Y that contains yellow ink, one tank 9M that contains magenta ink, and one tank 9C that contains cyan ink are provided in the tank unit 3 of the first embodiment (see FIG. 1(*b*)). Note that the number of tanks 9 may be a number other than four, and the types of ink contained therein may be different from the above-described four colors of ink.

The supply tubes 4 include the same number of tubes as the number of tanks 9. In the first embodiment, four tubes, namely, a supply tube 4 connected to the tank 9Bk, a supply tube 4 connected to the tank 9Y, a supply tube 4 connected to the tank 9M, and a supply tube 4 connected to the tank 9C are provided as the supply tubes 4. The four tubes constitute a four-route ink passage corresponding to the four colors of ink. Four groups of ink nozzles for respectively discharging the four colors of ink are provided in the printing head of the mechanism unit 10.

The over-tank case 7 is provided with an upper face 71 directed in the +Z direction, a side face 72 directed in the +X direction, and a side face 73 (first face) directed in the −X direction (first direction). Four openings 74 are provided in the upper face 71 of the over-tank case 7. In addition, as shown in FIG. 1(*b*), four window portions 75 (visual recognition portions) are provided in the side face 73 of the over-tank case 7. The window portions 75 are openings passing through the side face 73. As shown in FIG. 1, the tank unit 3 houses the above-described four tanks 9 (9Bk, 9Y, 9M and 9C) at positions at which the tanks 9 are visually recognizable from the four window portions 75. The over-tank case 7 is provided with an engagement portion (not illustrated) that engages with the under-tank case 8. When the over-tank case 7 and the under-tank case 8 are assembled, the engagement portion of the over-tank case 7 and an engagement target portion of the under-tank case 8 engage with each other, and the over-tank case 7 is fixed to the under-tank case 8.

Figure 3:
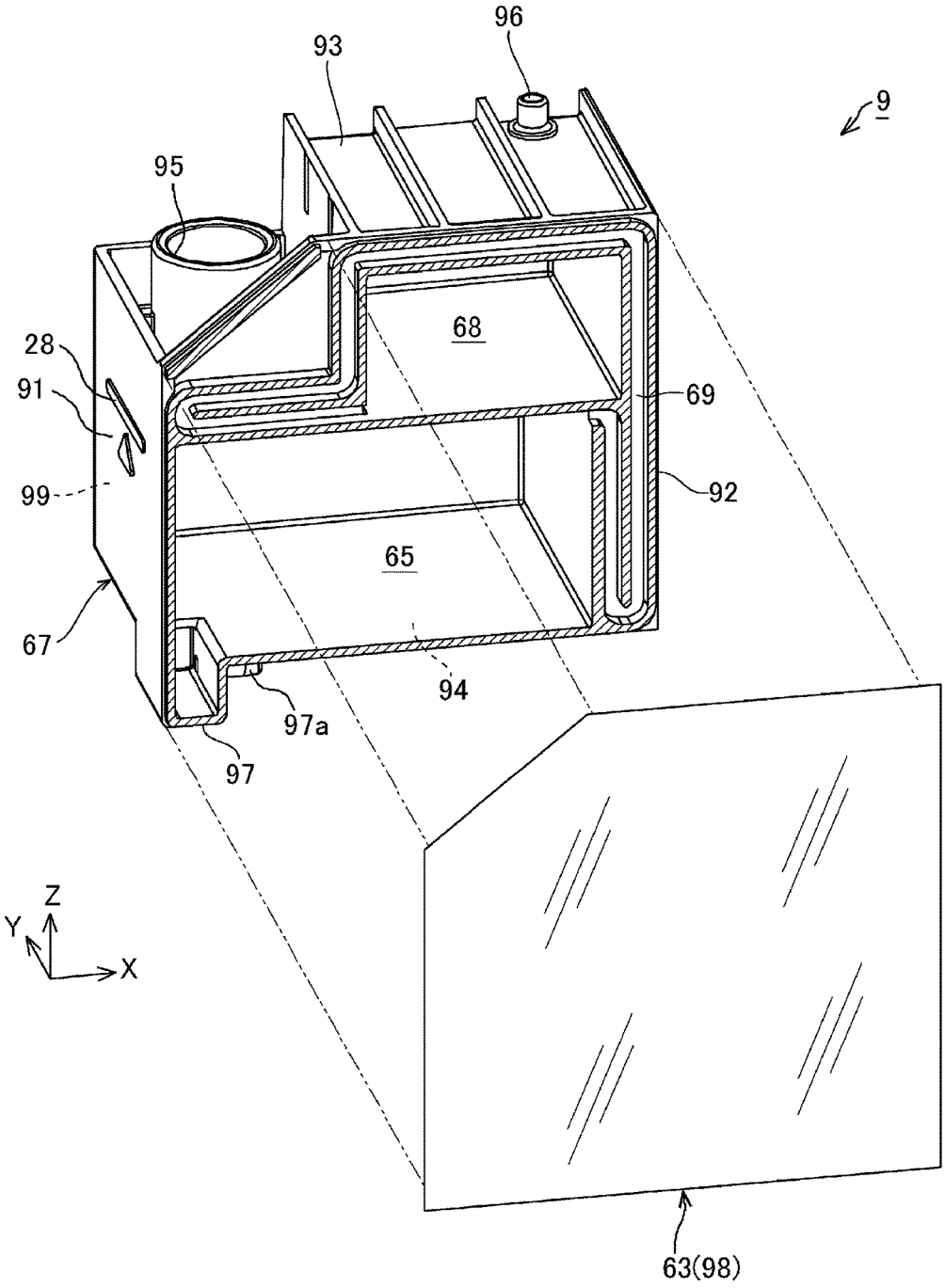
FIG. 3 is an exploded perspective diagram of a tank.

As shown in FIG. 1(*b*), out of the four tanks 9 (9Bk, 9Y, 9M and 9C), the tanks 9Y, 9M and 9C have the same shape and the same volume. In addition, the tank 9Bk has a dimension in the Y axis direction greater than the other tanks, and has a larger volume than the other tanks. FIG. 3 is an exploded perspective diagram of a tank 9. A configuration common to the four tanks 9 (9Bk, 9Y, 9M and 9C) will be described below with reference to FIG. 3. The face directed in the −X direction of the tank 9, that is, a face visually recognized from a window portion 75 of the over-tank case 7 is assumed to be a front face 91 of the tank 9. Also, the face directed in the +X direction is assumed to be a rear face 92 of the tank 9. The tank 9 has a case 61 and a sheet member 63. The sheet member 63 is formed of synthetic resin (e.g., nylon or polypropylene) to be film-like, and has flexibility. The sheet member 63 is joined to the case 61 by a joining method such as welding.

A storing portion 65, an atmospheric air chamber 68 and a communication path 69 are provided in the tank 9. The storing portion 65 and the atmospheric air chamber 68 are in communication with each other via the communication path 69. Ink is contained in the storing portion 65. In the tank 9, an ink injection portion 95 is provided in an upper face 93 directed in the +Z direction. Also, a portion of the upper face 93 projects in the +Z direction, and an atmospheric air communication port 96 is provided here. Also, in the tank 9, a supplying portion 97 projects from a bottom face 94 directed in the −Z direction. A cylindrical connection portion 97*a* protrudes from the supplying portion 97. A supply tube 4 (4Bk/4Y/4M/4C) is connected to the connection portion 97*a*. Ink contained in the tank 9 is sent out from a supply port provided at the leading end of the connection portion 97*a* to the supply tube 4.

An ink sensor (not illustrated) for detecting ink in the tank 9 is provided in the tank 9. For example, the ink sensor is an optical sensor that uses a prism or the like provided on the bottom portion of the storing portion 65. By providing the optical sensor on the bottom portion of the storing portion 65, it is possible to detect that the residual amount of ink in the tank has decreased to below a predetermined amount (near end). Alternatively, a sensor that adopts another detection method may be used. For example, the sensor may be an electrode type sensor. An electrode type sensor is an ink sensor that measures the value of an electric current that flows between a pair of electrodes provided near the bottom portion of the storing portion 65, and thereby determines whether or not ink exists between the electrodes. Moreover, a wire connected to the ink sensor extends together with the supply tube 4 on the rear face 92 side of the tank 9, and is routed into the printer 2. When the tank unit 3 is at the first position 3A, and the liquid ejecting system 1 is being used, the ink sensor can detect ink.

Figure 4A:
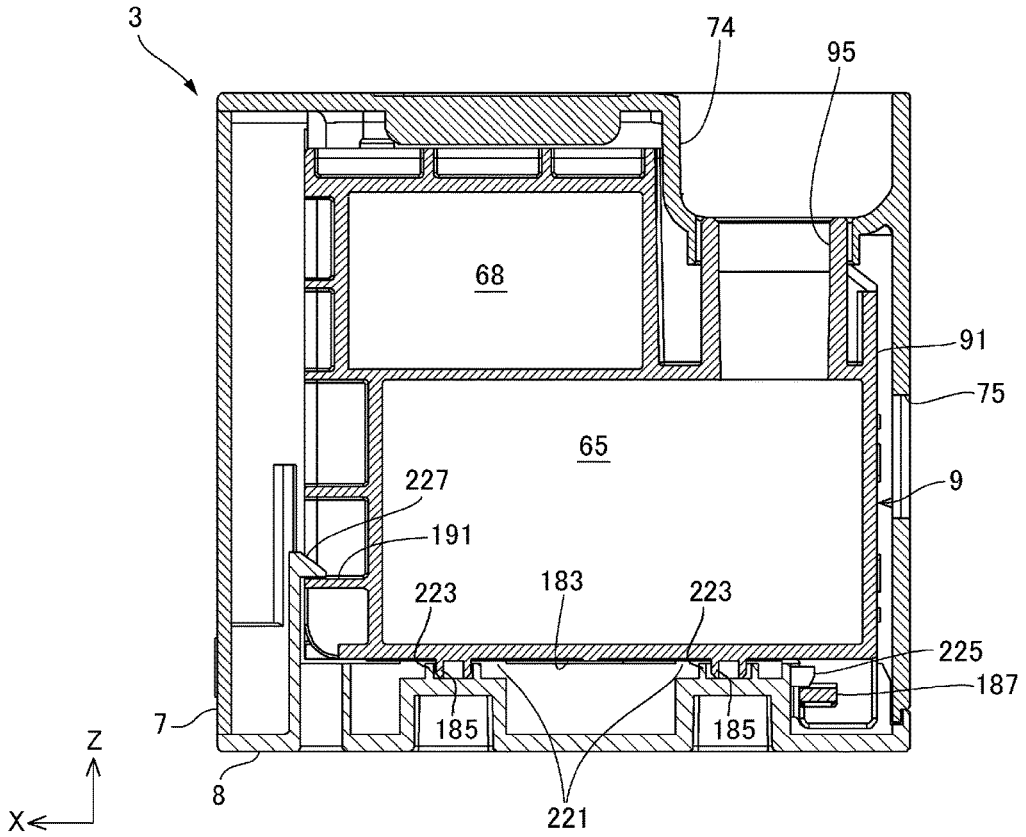
FIGS. 4A and 4B are cross-sectional views of the tank unit.
Figure 4B:
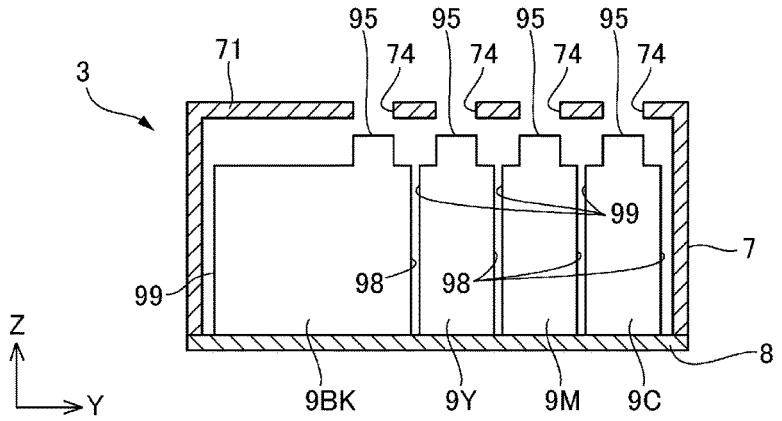

FIG. 4 includes cross-sectional views formed by cutting the tank unit 3, where FIG. 4(*a*) is a cross-sectional view of the tank unit 3 cut along the XZ plane, and FIG. 4(*b*) is an explanatory diagram schematically showing the cross-sectional structure of the tank unit 3 cut along the YZ plane. The four tanks 9 (9Bk, 9Y, 9M and 9C) are placed on the under-tank case 8. As shown in FIG. 4(*a*), the under-tank case 8 is provided with two mount portions 221, two recess portions 223, a first engagement portion 225 and a second engagement portion 227 in each region in which the bottom face 94 of a tank 9 is placed. On the other hand, a supported portion 183, two projection portions 185 and a first engagement target portion 187 are provided on the bottom face 94 of the tank 9. The tank 9 is arranged such that the supported portion 183 of the bottom face 94 is placed on the two mount portions 221 of the under-tank case 8, and the two projection portions 185 of the bottom face 94 are inserted into the two recess portions 223 of the under-tank case 8. In this state, the first engagement target portion 187 of the tank 9 engages with the first engagement portion 225 of the under-tank case 8, and a second engagement target portion 191 of the tank 9 engages with the second engagement portion 227 of the under-tank case 8. Thereby, the tank 9 is fixed to the under-tank case 8.

As shown in FIG. 4(*b*), in the state where the four tanks 9 (9Bk, 9Y, 9M and 9C) are housed between the over-tank case 7 and the under-tank case 8, the ink injection portions 95 of the tanks can be accessed from the four openings 74 formed in the upper face 71 of the over-tank case 7. The ink injection portions 95 are blocked by a cap member (not illustrated) at the time of printing. In the state where the tanks 9 (9Bk, 9Y, 9M and 9C) are housed between the over-tank case 7 and the under-tank case 8, it is possible to remove the cap member, and inject ink from the ink injection portion 95.

As shown in FIGS. 1(*b*) and 4(*b*), the four openings 74 of the over-tank case 7 are arranged in the Y axis direction. Also, the four tanks 9, namely, 9Bk, 9Y, 9M and 9C are arranged in the stated order from the −Y direction side toward the +Y direction side. The tanks 9Y, 9M and 9C have the same shape. However, the tank 9Bk has a larger dimension in the Y axis direction than the other tanks 9Y, 9M and 9C, and has a larger volume than the other tanks 9Y, 9M and 9C. Out of the four tanks 9, all the tanks 9Y, 9M and 9C (first liquid storing portions) having a smaller volume are positioned on the +Y direction side (third direction side) relative to the tank 9Bk whose volume is largest (second liquid storing portion). Therefore, the ink injection portions 95 (95Y, 95M and 95C) (first liquid injection ports) of the tanks 9Y, 9M and 9C whose volume is smaller are positioned on the +Y direction side (third direction side) relative to an ink injection portion 95Bk (second liquid injection port) of the tank 9Bk whose volume is the largest.

Each of the tanks 9Bk, 9Y, 9M and 9C is provided with a side face 98 (third face) directed toward the +Y direction side (third direction side), and a side face 99 (fourth face) directed toward the −Y direction side (fourth direction side). As shown in FIG. 3, the side face 98 directed toward the +Y direction side is formed by the sheet member 63, and the side face 99 directed toward the −Y direction side is formed by the case 61. In the upper face 93 of the tank 9Bk, the ink injection portion 95 of the tank 9Bk whose volume is largest is provided at a position closer to the side face 98 directed toward the +Y direction side than to the side face 99 directed toward the −Y direction side. Therefore, the four ink injection portions 95 are arranged in a group at positions nearer the +Y direction side, in the upper face 71 of the over-tank case 7.

As shown in FIG. 1(*b*), in the state where the tanks 9Bk, 9Y, 9M and 9C are housed between the over-tank case 7 and the under-tank case 8, portions of the tanks 9Bk, 9Y, 9M and 9C are exposed through the four window portions 75 formed in the side face 73 of the over-tank case 7, to the outside of the over-tank case 7. The front faces 91 of 9Bk, 9Y, 9M and 9C are positioned at positions at which the front faces 91 are visible from the window portions 75. As shown in FIG. 3, an upper limit mark 28 indicating the upper limit of the amount of ink is formed on the front faces 91 of the tanks 9 (9Bk, 9Y, 9M and 9C). The upper limit mark 28 is formed at a position facing the window portion 75.

When the tank unit 3 is at the first position 3A, the four window portions 75 face the side face 53 of the upper case 5 of the printer 2 and are hidden by the printer 2, but in the state where the tank unit 3 is pulled out to the second position 3B, the four window portions 75 do not face the side face 53, and are not hidden by the printer 2. Therefore, when the tank unit 3 is pulled out to the second position 3B, the amount of ink in the tank 9 is visually recognizable from the region of the tank 9 viewed through the window portion 75. The upper limit mark 28 is provided in the region of the tank 9 that is viewed through the window portion 75, and thus when injecting ink into the tank 9, it is possible to visually recognize, through the window portion 75, that the amount of ink in the tank 9 has reached an upper limit amount set in advance.

The window portions 75 of the over-tank case 7 include a window portion 75 (second visual recognition window) through which the tank 9Bk is visually recognizable, a window portion 75 (first visual recognition window) through which the tank 9Y is visually recognizable, a window portion 75 (first visual recognition window) through which the tank 9M is visually recognizable, and a window portion 75 (first visual recognition window) through which the tank 9C is visually recognizable. These four window portions 75 have the same shape, and are arranged in this order in the side face 73 of the over-tank case 7, from the −Y direction toward the +Y direction side. The upper limit mark 28 is formed on the front face 91 of the tank 9Bk whose volume is largest, at a position closer to the side face 98 directed toward the +Y direction side than to the side face 99 directed toward the −Y direction side. In addition, the window portion 75 (second visual recognition window) through which the tank 9Bk is visually recognizable is provided at a position at which this upper limit mark 28 is visually recognizable, in other words, a position closer to the side face 98 than to the side face 99 of the tank 9Bk. Therefore, the four window portions 75 are arranged in a group in the side face 73 of the over-tank case 7, at a position nearer the +Y direction side.

Figure 5A:
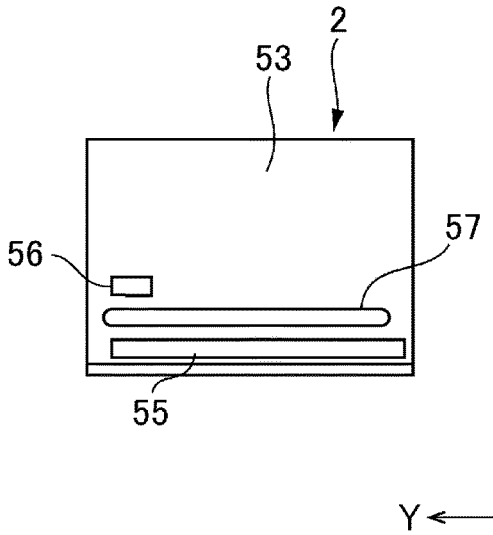
FIGS. 5A and 5B are explanatory diagrams schematically showing the arrangement of engagement portions and opening portions that are provided on a side face of a printer and a side face of the tank unit.
Figure 5B:
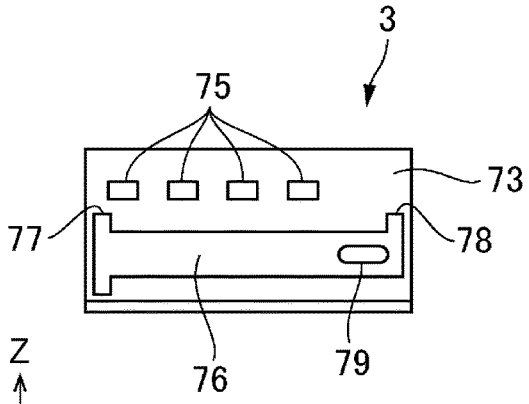
Figure 6A:
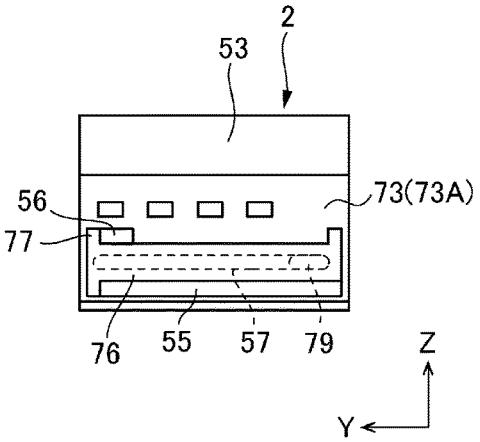
FIGS. 6A and 6B are explanatory diagrams schematically showing engagement states of the printer and the tank unit.
Figure 6B:
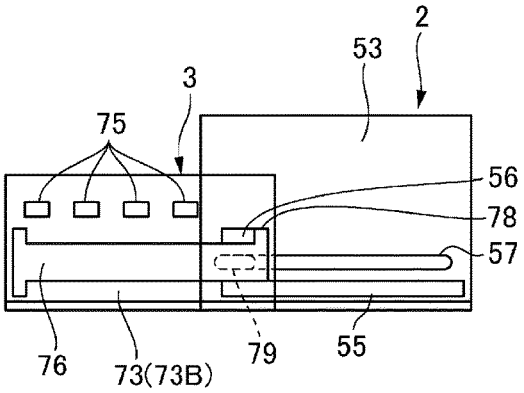

FIGS. 5 and 6 include explanatory diagrams schematically showing the arrangement of engagement portions and opening portions provided on a side face of the printer 2 and a side face of the tank unit 3, where FIG. 5(*a*) shows engagement portions and an opening portion provided in the side face 53 of the printer 2, and FIG. 5(*b*) shows an engagement portion and an opening portion provided in the side face 73 of the tank unit 3. Also, FIG. 6 includes explanatory diagrams schematically showing engagement states of the printer 2 and the tank unit 3, where FIG. 6(*a*) shows a state where the tank unit 3 is at the first position 3A, and FIG. 6(*b*) shows a state where the tank unit 3 is at the second position 3B. FIGS. 5 and 6 show the arrangement in the case where the side faces of the printer 2 and the tank unit 3 are viewed in the −X direction (i.e., viewed in a direction from the tank unit 3 toward the printer 2).

As described above, the printer 2 is provided with the side face 53 (second face) directed in the +X direction (second direction) toward the tank unit 3, and two guide rails 55 and 56 (liquid ejecting apparatus-side engagement portions) extending in parallel in the Y axis direction are formed on this side face 53. At a position near the lower end of the side face 53, the guide rail 55 extends from a position near the side edge in the +Y direction of the side face 53 to a position near the side edge in the −Y direction of the side face 53. On the other hand, the guide rail 56 is positioned on the +Z direction side relative to the guide rail 55. The guide rail 56 extends from a substantially central position in the Y axis direction of the side face 53 to the same position as the end portion in the +Y direction of the guide rail 55. Note that in FIG. 1(*b*), illustration of the guide rails 55 and 56 is omitted.

On the other hand, the tank unit 3 is provided with the side face 73 (first face) directed in the −X direction (first direction) toward the printer 2, and a guide rail 76 (liquid storing container-side engagement portion) extending in the Y axis direction is formed on this side face 73. The position in the Z axis direction (height) of the guide rail 76 is at the same height as a groove-shaped portion between the guide rails 55 and 56 provided on the printer 2 side, and the guide rail 76 is engaged between the guide rails 55 and 56. The guide rails 55 and 56 on the printer 2 side engage with the guide rail 76 on the tank unit 3 side such that the tank unit 3 cannot relatively move in the X axis direction and the Z axis direction with respect to the printer 2, and engagement is performed such that the tank unit 3 can slide in the Y axis direction relative to the printer 2. The guide rails 55 and 56 and the guide rail 76 are formed at positions at which the guide rails do not overlap the above-described the window portions 75, and in this embodiment, are positioned on the −Z direction side (lower side) relative to the window portions 75. Note that in FIG. 1(*b*), illustration of the guide rail 76 is omitted.

A front-side retaining portion 77 is provided at the end portion on the +Y direction side of the guide rail 76, and a rear-side retaining portion 78 is provided at the end portion on the −Y direction side. When the tank unit 3 is positioned at the first position 3A, the front-side retaining portion 77 abuts on the guide rails 55 and 56 from the +Y direction. Also, when the tank unit 3 is positioned at the second position 3B, the rear-side retaining portion 78 abuts on the guide rail 55 from the −Y direction. Therefore, the movable range of the tank unit 3 is a range from the first position 3A to the second position 3B, and the tank unit 3 never moves out of this range. When the tank unit 3 is at the first position 3A, the side face 73 of the tank unit 3 is positioned at a first position 73A with respect to the side face 53 of the printer 2. Moreover, when the tank unit 3 is at the second position 3B, the side face 73 of the tank unit 3 is positioned at a second position 73B that is different from the first position 73A, with respect to the side face 53 of the printer 2. The second position 73B is a position that is moved to the +Y direction side (third direction side) relative to the first position 73A.

An apparatus-side opening portion 57 extending in the Y axis direction is formed in the side face 53 of the printer 2 at a position between the guide rail 55 and the guide rail 56. In addition, a container-side opening portion 79 extending in the Y axis direction is formed in the side face 73 of the tank unit 3 at a substantially central position in the Z axis direction of the guide rail 76. The positions in the Z axis direction (heights) of the apparatus-side opening portion 57 and the container-side opening portion 79 are the same, and the opening widths in the Z axis direction are also the same. The apparatus-side opening portion 57 extends in a range from one end to the other end of the side face 53 of the printer 2 in the Y axis direction, and the container-side opening portion 79 extends only in a region near the end in the +Y direction side of the side face 73 of the tank unit 3.

At whichever of the first position 3A and the second position 3B the tank unit 3 is positioned, at least portions of the apparatus-side opening portion 57 and the container-side opening portion 79 overlap each other when viewed in the X axis direction. The supply tubes 4 pass through the portions of the apparatus-side opening portion 57 and the container-side opening portion 79 that overlap each other, and are routed from inside the tank unit 3 into the printer 2. Accordingly, the supply tubes 4 are in communication with the interior of the printer 2 via the apparatus-side opening portion 57, and are in communication with the interior of the tank unit 3 via the container-side opening portion 79. Therefore, when the tank unit 3 moves between the first position 3A and the second position 3B, the connection between the printer 2 and the tank unit 3 using the supply tubes 4 can be maintained. In addition, with such a configuration, the supply tubes 4 are not exposed to the outside. Therefore, there is no risk that the user inadvertently comes into contact with and damages the supply tubes 4.

At whichever of the first position 3A and the second position 3B the tank unit 3 is positioned, the container-side opening portion 79 is covered by the side face 53 of the printer 2 and is not exposed to the outside. Therefore, the entrance of dust, foreign materials and the like into the tank unit 3 is suppressed. On the other hand, when the tank unit 3 is at the first position 3A, the apparatus-side opening portion 57 is covered by the side face 73 of the tank unit 3 and is not exposed to the outside, but when the tank unit 3 is at the second position 3B, a portion on the −Y direction side of the apparatus-side opening portion 57 is not covered by the side face 73 of the tank unit 3, and is in a state of being exposed to the outside.

Figure 7:
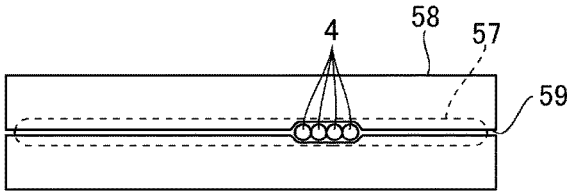
FIG. 7 is an explanatory diagram schematically showing a protection structure of an apparatus-side opening portion.

FIG. 7 is an explanatory diagram schematically showing a protection structure of the apparatus-side opening portion 57. A protection member 58 is mounted to the side face 53 of the printer 2 so as to block a portion of the apparatus-side opening portion 57 that is exposed to the outside. For example, the protection member 58 is formed by an elastic member made of rubber, elastomer or like. A slit 59 through which the supply tubes 4 pass is formed in the protection member 58. The protection member 58 blocks the apparatus-side opening portion 57, except for a space through which the supply tubes 4 pass. Therefore, the interior of the printer 2 is not exposed to the outside, and the entrance of dust, foreign materials and the like into the printer 2 is suppressed.

The apparatus-side opening portion 57 and the container-side opening portion 79 are used not only as openings through which the supply tubes 4 pass but also as openings through which the wires connected to the ink sensors provided in the tanks 9 pass. Accordingly, the apparatus-side opening portion 57 functions as both an apparatus-side conduit opening portion and a container-side conduit opening portion. Also, the container-side opening portion 79 functions as both an apparatus-side wiring opening portion and a container-side wiring opening portion. The wires that are routed from the ink sensors into the printer 2 are arranged so as to pass through the apparatus-side opening portion 57 and the container-side opening portion 79. In other words, the wires are connected to the interior of the printer 2 via the apparatus-side opening portion 57, and are connected to the interior of the tank unit 3 via the container-side opening portion 79. As a result, when the tank unit 3 moves between the first position 3A and the second position 3B, the connection between the printer 2 and the ink sensor using the wires is maintained, and the wires are not exposed to the outside.

Note that two openings may be provided in the side face 53 of the printer 2, with one serving as the apparatus-side conduit opening portion and the other serving as the apparatus-side wiring opening portion. For example, the apparatus-side opening portion 57 may be divided into two in the Z axis direction, with one serving as the apparatus-side conduit opening portion, and the other serving as the apparatus-side wiring opening portion. Similarly, two openings may be provided in the side face 73 of the tank unit 3, with one serving as the container-side conduit opening portion, and the other serving as the container-side wiring opening portion.

As described above, the supply tubes 4 include four tubes, namely, the supply tube 4 connected to the tank 9Bk, the supply tube 4 connected to the tank 9Y, the supply tube 4 connected to the tank 9M, and the supply tube 4 connected to the tank 9C. The four supply tubes 4 are bound with a binding band or the like, and are arranged so as to pass through the apparatus-side opening portion 57 and the container-side opening portion 79. Portions of the supply tubes 4 that extend from the binding position to the tank 9 side have a surplus portion, and have a length that allows bending and extending in accordance with the tank unit 3 moving between the first position 3A and the second position 3B. Accordingly, a supply tube 4C that is connected to the tank 9C positioned nearest the +Y direction side has the most slack and the longest surplus portion when the tank unit 3 is at the first position 3A. On the other hand, a supply tube 4Bk connected to the tank 9Bk positioned nearest the −Y direction side has the most slack and the longest surplus portion when the tank unit 3 is at the second position 3B. As a result, the supply tubes are not brought into a state of being much more loose than necessary.

Actions and Effects

As described above, in the liquid ejecting system 1 of the first embodiment, the tank unit 3 slidably engages with the side face 53 directed toward the +X direction side of the printer 2, and it is possible to slide the tank unit 3 in the +Y direction and pull it out forward, and to expose, to the outside, the side face 73 directed in the −X direction of the tank unit 3. Due to this operation, the interior of the tank unit 3 is visually recognizable through the window portions 75 formed in the side face 73 directed in the −X direction of the tank unit 3, and the amount of ink in the tanks 9 is visually recognizable from the window portions 75. In this manner, the operation of sliding the tank unit 3 and pulling it out to the front side is easy. Moreover, when checking the interior of the tank unit 3, observation is possible through the window portions 75 of the tank unit 3 from the printer 2 side (the −X direction side), and it is not necessary to perform the operation of observing the tank unit 3 from the side opposite to the printer 2 (the +X direction side: outward of the liquid ejecting system 1 in the width direction). Therefore, it is not necessary to secure a working space outside of the liquid ejecting system 1 in the width direction. Therefore, even in the case where the liquid ejecting system 1 is installed in a limited space, the tank unit 3 can be easily moved to a position at which the ink amount can be checked. Accordingly, operations on the tank unit 3 can be made easy. For example, it is possible to reduce the workload when checking the ink amount.

In addition, in the first embodiment, the four tanks 9 are arranged in the direction of the movement (the Y axis direction) when pulling out the tank unit 3, and out of the four tanks 9, the tank 9Bk that contains black ink, which is pigment ink, is arranged farthest on the −Y direction side (the rearmost side in the direction of the movement when pulling out the tank unit 3/back side in a front view of the liquid ejecting system 1). With such an arrangement, the movement amount of the tank unit 3 for pulling out the tank unit 3 to a position at which the ink amount of black ink can be checked is long. Therefore, when checking the ink amount of black ink, the tank unit 3 moves a large amount, and the ink in the tank 9Bk is stirred a large amount. Therefore, sedimentation of the pigment can be suppressed.

Moreover, in the first embodiment, when the tank 9Bk having the largest volume out of the four tanks 9 is arranged farthest on the −Y direction side, the ink injection portion 95 of this tank 9Bk is arranged at a position closer to the side face 98 directed towards the +Y direction side than to the side face 99 directed towards the −Y direction side, on the upper face 93 of the tank 9Bk. In addition, the window portion 75 facing the tank 9Bk is also arranged at a position closer to the side face 98 than to the side face 99 of the tank 9Bk. With such an arrangement, the four ink injection portions 95 are arranged in a group in the upper face 71 of the over-tank case 7 at positions nearer the +Y direction side. Also, the four window portions 75 are arranged in a group at positions nearer the +Y direction side, in the side face 73 of the over-tank case 7. By arranging, in this manner, the ink injection portions 95 and the window portions 75 in a group on the direction side (front side) on which the tank unit 3 is pulled out, it is possible to reduce the amount of a space required to pull out the tank unit 3 when checking the ink amount or injecting ink. Moreover, it is possible to improve the operation efficiency when checking the ink amount, and it is possible to improve the operation efficiency when injecting ink.

Furthermore, in the first embodiment, the supply tubes 4 and the wiring that connect the printer 2 and the tank unit 3 are routed so as to pass through the apparatus-side opening portion 57 formed in the side face 53 on the +X direction side of the printer 2 and the container-side opening portion 79 formed in the side face 73 on the −X direction side of the tank unit 3. In this manner, the supply tubes 4 and the wiring can be routed along a simple route by passing the supply tubes 4 and the wiring through the openings formed in the opposing faces. Moreover, in the first embodiment, even if the tank unit 3 moves between the first position 3A and the second position 3B, the apparatus-side opening portion 57 and the container-side opening portion 79 are not exposed to the outside. Therefore, exposure of the supply tubes 4 and the wiring to the outside can be prevented. Also, it is possible to prevent the entrance of dust, foreign materials and the like from into the printer 2 and the tank unit 3.

In addition, in the first embodiment, in the state where the tank unit 3 is positioned at the first position 3A, the ink residual amount can be detected using the ink sensor, and in the state where the tank unit 3 is pulled out to the second position 3B, the ink amount can be checked from the window portions 75. Therefore, ink can be injected while checking the ink amount by pulling out the tank unit 3 to the second position 3B. Also, while ink is supplied to the printer 2 by bringing the tank unit 3 back to the first position 3A, the ink residual amount can be detected using the ink sensor. Therefore, the ink injecting operation is easy. Moreover, it is possible to know that the ink residual amount has become low while printing is being performed.

Modified Examples

1. In the first embodiment, at the second position 3B, the apparatus-side opening portion 57 is exposed to the outside, and the protection member 58 is attached so as to block this portion, but a configuration is possible in which the apparatus-side opening portion 57 is not exposed to the outside at the second position 3B, and the container-side opening portion 79 is exposed to the outside at the second position 3B. In this case, it is desirable that a protection structure similar to the protection member 58 is provided in a region of the container-side opening portion 79 that is exposed to the outside. Alternatively, a configuration may be adopted in which, at whichever of the first position 3A and the second position 3B the tank unit 3 is positioned, both the apparatus-side opening portion 57 and the container-side opening portion 79 are covered by the side face 73 of the tank unit 3 and the side face 53 of the printer 2, and are not exposed to the outside. In this case, it is not necessary to provide the protection structure.

2. In the first embodiment, the window portion 75 of the tank unit 3 is formed at the same height as a region (see FIG. 3) in the front face 91 of the tank 9 in which the upper limit mark 28 indicating the upper limit of the amount of ink is added, but it is also possible to add, to the front face 91 of the tank 9, a lower limit mark indicating the lower limit of the amount of ink, and to form the window portion 75 at the same height as the lower limit mark. Alternatively, it is also possible to add both the upper limit mark 28 and the lower limit mark to the front face of the tank 9, and to form the window portion 75 such that both of these are visually recognizable from the outside. In the case where the lower limit mark and the window portion 75 through which this is visually recognizable are formed, when the tank unit 3 is pulled out to the second position 3B, it is possible to check whether or not the amount of ink in the tank 9 is lower than a lower limit amount set in advance. Therefore, it is possible to check that the residual amount of ink has become low.

Second Embodiment

Figure 8A:
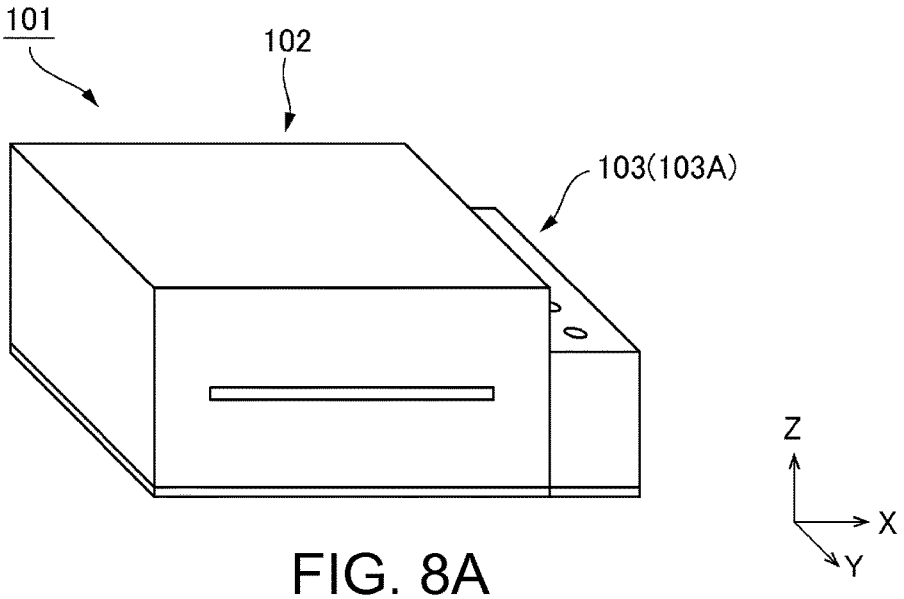
FIGS. 8A and 8B are explanatory diagrams schematically showing a liquid ejecting system according to a second embodiment.
Figure 8B:
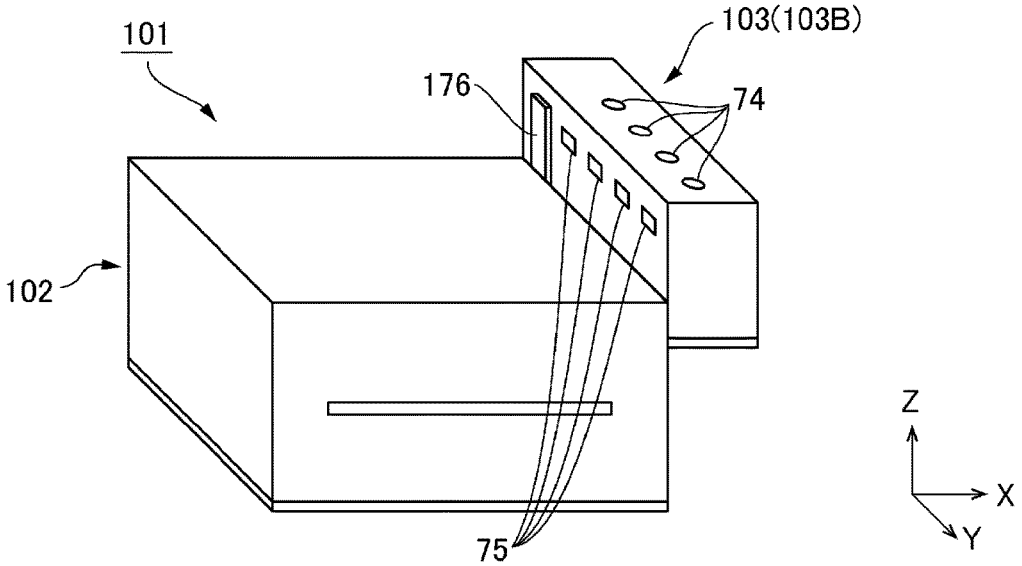

FIG. 8 includes explanatory diagrams schematically showing a liquid ejecting system of a second embodiment, where FIG. 8(*a*) shows a state where a tank unit is at a first position at which the tank unit is aligned with a printer, and FIG. 8(*b*) shows a state where the tank unit is at a second position upward relative to the printer. Hereinafter, description of the same constituent elements as those in the first embodiment is omitted, and only different constituent elements will be described. In a liquid ejecting system 101 of the second embodiment, a tank unit 103 is slidable relative to a printer 102 in the Z axis direction. As shown in FIG. 8(*b*), a guide rail 176 extending not in the Y axis direction but in the Z axis direction is provided on the side face directed in the −X direction of the tank unit 103. Moreover, a guide rail (not illustrated) extending not in the Y axis direction but in the Z axis direction is provided on the side face of the printer 102 that is directed in the +X direction. The guide rail of the printer 102 and the guide rail 176 of the tank unit 103 engage with each other so as to be slidable in the Z axis direction.

As shown in FIG. 8(*a*), the tank unit 103 of the second embodiment is usually positioned at a first position 103A at which the tank unit 103 is aligned with the printer 102 in the X axis direction. In this state, a printing operation and the like of the printer 102 is performed. In addition, as shown in FIG. 8(*b*), the tank unit 103 is pulled out to a second position 103B upward (the +Z direction side) relative to the printer 102. At the second position 103B, four window portions 75 provided in the tank unit 103 are exposed to the outside. Therefore, similarly to the first embodiment, even in the case where the liquid ejecting system 101 is installed in a limited space, the tank unit 103 can be easily moved to a position at which the ink amount can be checked. Therefore, operations on the tank unit 103 can be made easy. For example, it is possible to reduce the workload when checking the ink amount.

Third Embodiment

Figure 9A:
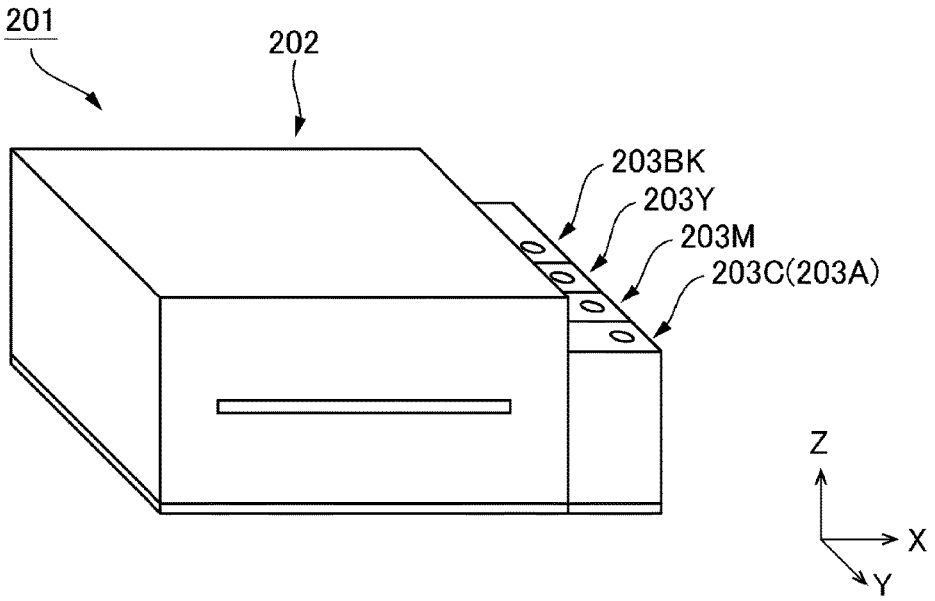
FIGS. 9A and 9B are explanatory diagrams schematically showing a liquid ejecting system according to a third embodiment.
Figure 9B:
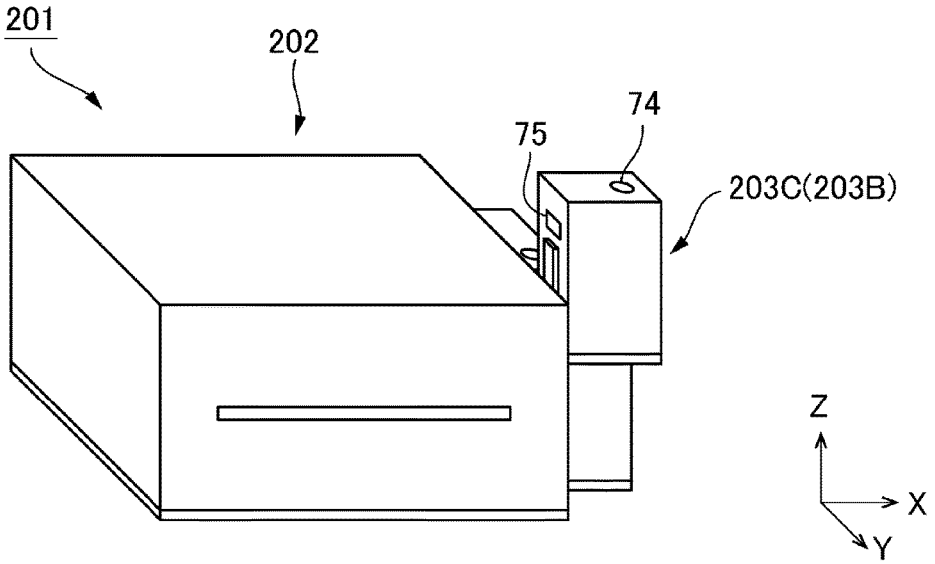

FIG. 9 includes explanatory diagrams schematically showing a liquid ejecting system of a third embodiment, where FIG. 9(*a*) shows a state where four tank units are at a first position at which the four tank units are aligned with a printer, and FIG. 9(*b*) shows a state where one of the tank units is at a second position upward relative to the printer. A liquid ejecting system 201 of the third embodiment is provided with four tank units 203Bk, 203Y, 203M and 203C arranged in the Y axis direction, a printer 202 and supply tubes (not illustrated). Each of the tank units 203Bk, 203Y, 203M and 203C is provided with the side face opposing the side face directed in the +X direction of the printer 202, and is slidable in the Z axis direction relative to the printer 202. Specifically, a slide structure using guide rails similar to that of the second embodiment is provided between the printer 202 and each of the tank units 203Bk, 203Y, 203M and 203C. Each of the four tank units 203Bk, 203Y, 203M and 203C is independently slidable relative to the printer 202.

The tank unit 203C is movable from a first position 203A shown in FIG. 9(*a*) to a second position 203B shown in FIG. 9(*b*). The tank 9C is housed in the tank unit 203C, and a window portion 75 is formed in the side face directed in the −X direction. The tank unit 203C has, in the side face in the −X direction, the window portion 75 that is exposed when moved to the second position 203B, and at the second position 203B, the tank 9C is visually recognizable from the window portion 75. In addition, similarly to the tank unit 203C, all of the tank units 203Bk, 203Y and 203M have, in the side face in the −X direction, a window portion 75 that is exposed when slid in the +Z direction, and the tanks 9Bk, 9Y and 9M inside are visually recognizable from these window portions 75.

In this manner, in the third embodiment, the four tank units 203Bk, 203Y, 203M and 203C can be individually slid such that the window portions 75 are exposed, in order to perform the operation of checking the ink amount and the operation of injecting ink. Therefore, similarly to the first and second embodiments, even in the case where the liquid ejecting system 201 is installed in a limited space, the tank units 203Bk, 203Y, 203M and 203C can be easily moved to a position at which the ink amount can be checked. Therefore, it is possible to reduce the workload when checking the ink amount, and the like.

Fourth Embodiment

Figure 10A:
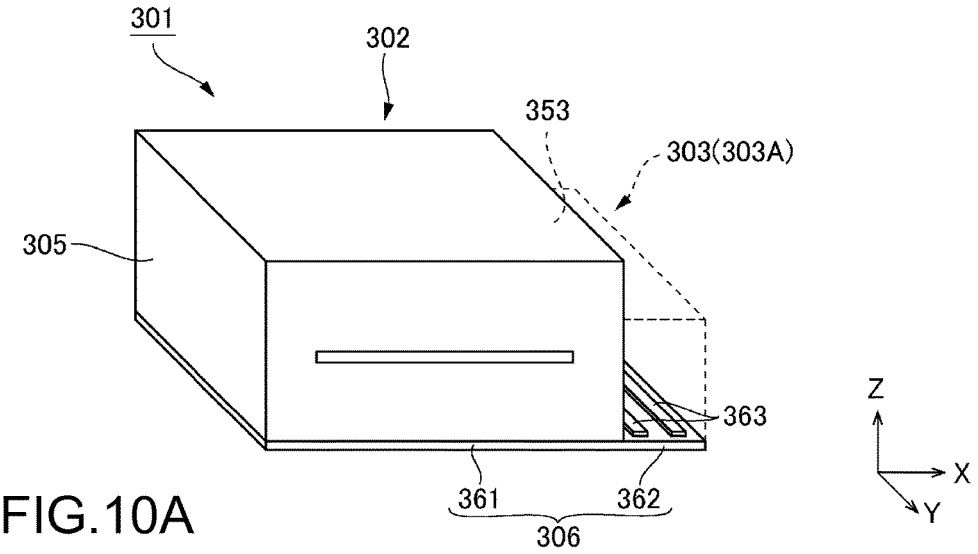
FIGS. 10A and 10B are explanatory diagrams schematically showing a liquid ejecting system according to a fourth embodiment.
Figure 10B:
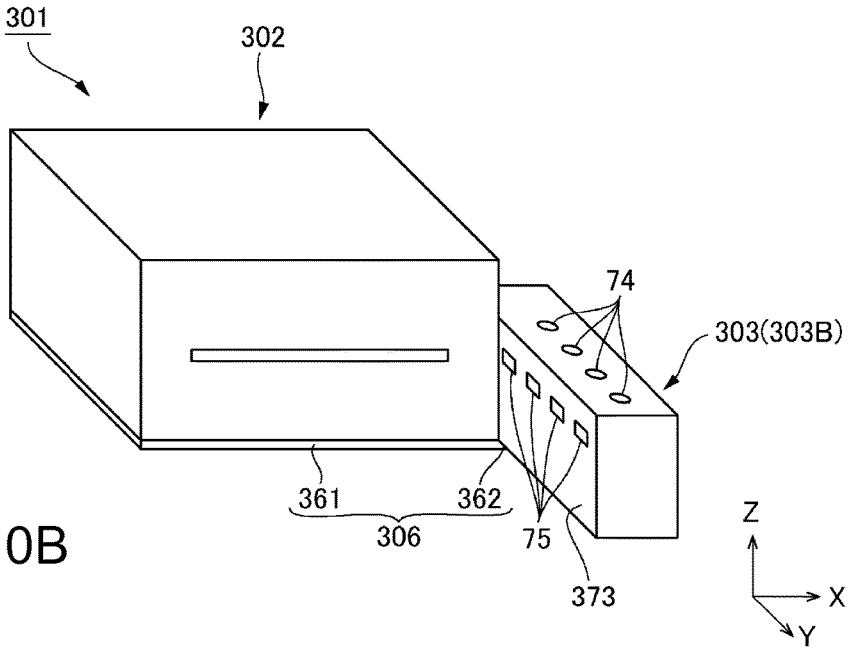

FIG. 10 includes explanatory diagrams schematically showing a liquid ejecting system of a fourth embodiment, where FIG. 10(*a*) shows a state where a tank unit is omitted, and FIG. 10(*b*) shows a state where a tank unit is at a second position at which the tank unit is on the front side relative to a printer. A liquid ejecting system 301 of the fourth embodiment is provided with a tank unit 303, a printer 302 and a supply tube (not illustrated). The printer 302 is provided with an upper case 305, a lower case 306 and a mechanism unit (not illustrated). The upper case 305 is provided with a side face 353 (second face) directed in the +X direction. The tank unit 303 is provided with a side face 373 (first face) directed towards the side face 353 side (the −X direction). The lower case 306 is provided with a first region 361 positioned on the −Z direction side of the upper case 305, and a second region 362 (extending portion) extending on the +X direction side relative to the side face 353 of the upper case 305. A space for housing the mechanism unit is formed between the first region 361 and the upper case 305. The tank unit 303 is arranged on the second region 362 of the lower case 306.

In the fourth embodiment, a slidable engagement structure such as a guide rail is not provided between the side face 353 of the upper case 305 and the side face 373 of the tank unit 303. Instead, guide rails 363 are formed on the upper face of the second region 362 of the lower case 306. Also, a guide rail (not illustrated) that engages with the guide rails 363 are formed on the bottom face of the tank unit 303. The guide rail on the bottom face of the tank unit 303 and the guide rails 363 in the second region 362 of the lower case 306 engage with each other such that the tank unit 303 is slidable relative to the printer 302 in the Y axis direction.

As indicated by broken lines in FIG. 10(*a*), the tank unit 303 is usually positioned at a first position 303A aligned with the printer 302 in the X axis direction. In this state, a printing operation and the like of the printer 302 is performed. In addition, the tank unit 303 is pulled out to a second position 303B on the front side (the +Y direction side) relative to the printer 302, as shown in FIG. 10(*b*). In this state, checking of the amount of ink in the tank unit 303, and the like can be performed. Therefore, similarly to the first to third embodiments, even in the case where the liquid ejecting system 301 is installed in a limited space, the tank unit 303 can be easily moved to a position at which the ink amount can be checked. Therefore, it is possible to reduce the workload when checking the ink amount, or the like.

Fifth Embodiment

Figure 11A:
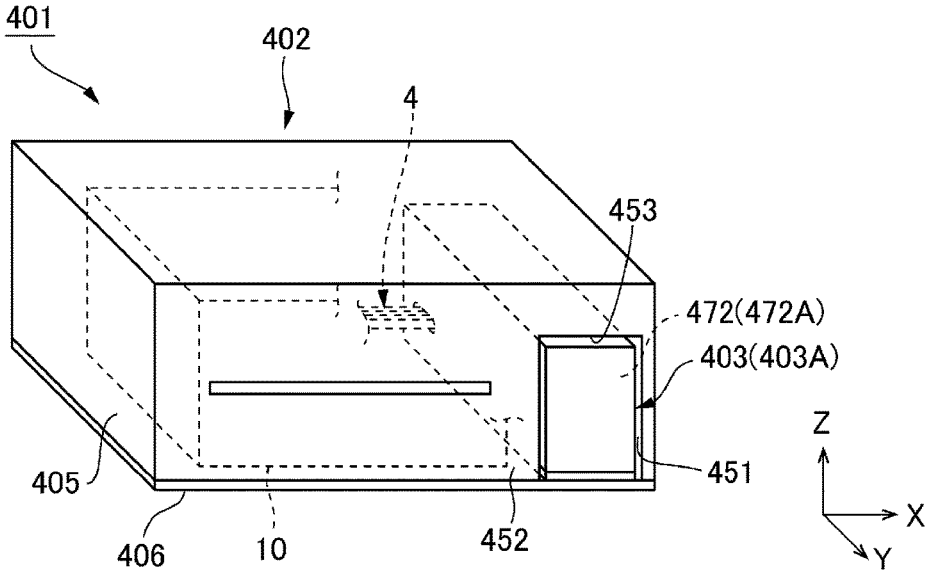
FIGS. 11A and 11B are explanatory diagrams schematically showing a liquid ejecting system according to a fifth embodiment.
Figure 11B:
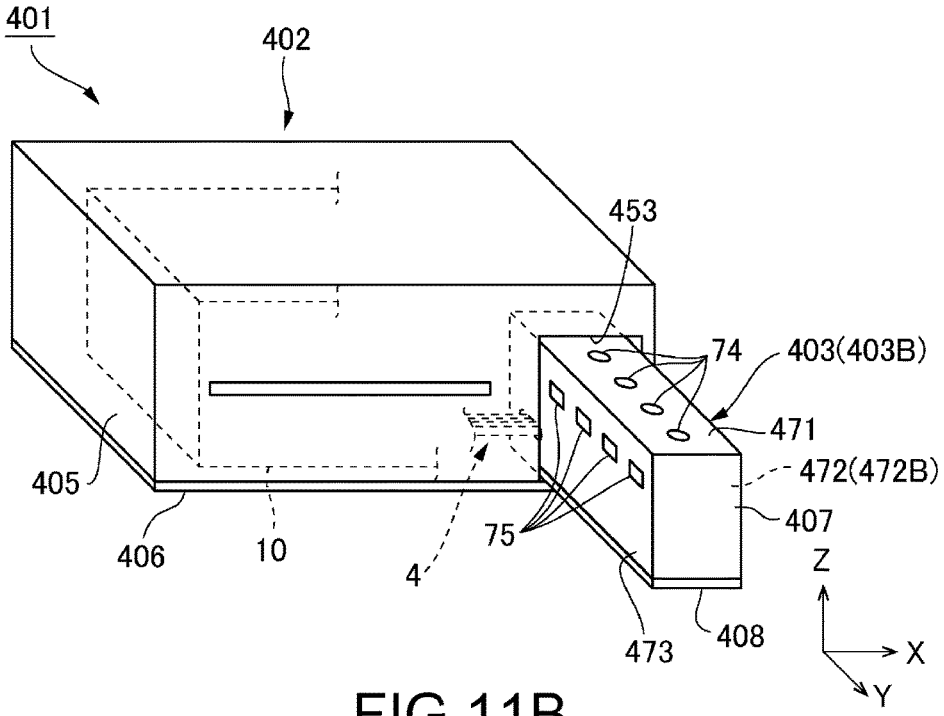

FIG. 11 includes explanatory diagrams schematically showing a liquid ejecting system of a fifth embodiment, where FIG. 11(*a*) shows a state where a tank unit is housed inside a printer, and FIG. 11(*b*) shows a state where the tank unit is pulled out forward relative to the printer. A liquid ejecting system 401 of the fifth embodiment is provided with a tank unit 403, a printer 402 and supply tubes 4. The printer 402 is provided with an upper case 405, a lower case 406 and a mechanism unit 10. The mechanism unit 10 and the tank unit 403 are housed between the upper case 405 and the lower case 406. A space for housing the tank unit 403 is provided on the +X direction side of the mechanism unit 10.

The tank unit 403 is provided with an over-tank case 407 and an under-tank case 408. The over-tank case 407 is provided with an upper face 471 directed in the +Z direction, a side face 472 (first face) directed in the +X direction and a side face 473 (third face) directed in the −X direction. Similarly to the tank unit 3 of the first embodiment, four openings 74 are provided in the upper face 471 of the over-tank case 407. Also, four window portions 75 are provided in the side face 473 of the over-tank case 407. Similarly to the embodiments above, four tanks 9Bk, 9Y, 9M and 9C are housed between the over-tank case 407 and the under-tank case 408 so as to face the window portions 75. The supply tubes 4 are connected to the four tanks 9Bk, 9Y, 9M and 9C. Ink in the tank unit 403 is supplied to the mechanism unit 10 via the supply tubes 4.

The upper case 405 is provided with an inner wall face 451 (second face) directed towards the −X direction side and a front face 452 directed in the +Y direction. When the tank unit 403 is housed inside the upper case 405, the side face 472 of the over-tank case 407 faces the inner wall face 451 of the upper case 405. The tank unit 403 is slidable in the Y axis direction relative to the printer 402. An opening 453 that allows the tank unit 403 to be taken in and out is provided in the front face 452 of the upper case 405. Note that an opening/closing lid for opening and closing the opening 453 may be provided. As shown in FIG. 9(*a*), the tank unit 403 is usually positioned at a first position 403A at which the tank unit 403 is housed in the printer 402. In this state, a printing operation and the like of the printer 402 is performed. Moreover, the tank unit 403 can be pulled out to a second position 403B on the front side (the +Y direction side) relative to the printer 402, as shown in FIG. 9(*b*).

When the tank unit 403 is at the first position 403A, the side face 472 of the over-tank case 407 is positioned at a first position 472A facing the inner wall face 451 of the upper case 405, and when the tank unit 403 is at the second position 403B, the side face 472 of the over-tank case 407 is positioned at a second position 472B that is different from the first position 472A. The second position 472B is a position moved from the first position 472A in the +Y direction. The four window portions 75 and the four openings 74 of the tank unit 403 are covered and hidden by the upper case 405, at the first position 403A. On the other hand, at the second position 3B (i.e., in a state where the side face 472 is moved to the second position 472B), the four window portions 75 and the four openings 74 of the tank unit 403 are not hidden by the upper case 405. Therefore, by pulling out the tank unit 403 to the second position 403B, it becomes possible to check the amount of ink in the tank unit 403, and it becomes possible to inject ink into the tank unit 403. Therefore, similarly to the first to fourth embodiments, operations on the tank unit 403 can be made easy. For example, it is possible to reduce the workload of the operation of checking the amount of ink in the tank unit 403 and the operation of injecting ink into the tank unit 403.

In addition, the cross-sectional structure of the tank unit 403 of the fifth embodiment cut along the YZ plane is similar to that of the tank unit 3 of the first embodiment (see FIG. 4(*b*)). Specifically, the tank unit 403 has the four tanks 9Bk, 9Y, 9M and 9C therein, and out of these, the tank 9Bk having the largest volume compared to the other tanks 9Y, 9M and 9C is arranged farthest on the −Y direction side, and an ink injection portion 95Bk of the tank 9Bk is arranged at a position closer to a side face 98 directed towards the +Y direction side than to a side face 99 directed towards the −Y direction side of the tank 9Bk. In addition, the window portion 75 facing the tank 9Bk is formed at a position closer to the side face 98 directed toward the +Y direction side than to the side face 99 directed toward the −Y direction side of the tank 9Bk. As a result, the four window portions 75 are arranged in a group at positions nearer the +Y direction side, in the side face 473 of the over-tank case 407. In this manner, by arranging the ink injection portions 95 and the window portions 75 in a group on the front side of the direction in which the tank unit 3 is pulled out, it is possible to reduce the amount of a space required to pull out the tank unit 403 when checking the ink amount and when injecting ink. It is also possible to improve the operation efficiency when checking the ink amount, and it is possible to improve the operation efficiency when injecting ink.

Sixth Embodiment

Figure 12A:
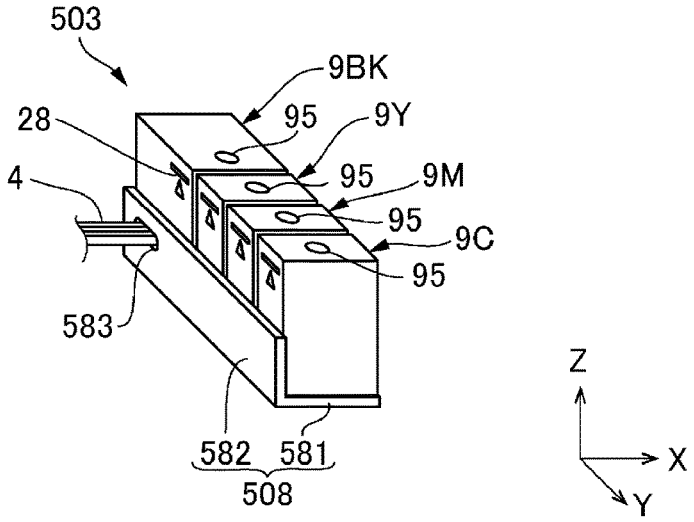
FIGS. 12A and 12B are explanatory diagrams schematically showing a liquid ejecting system according to a sixth embodiment.
Figure 12B:
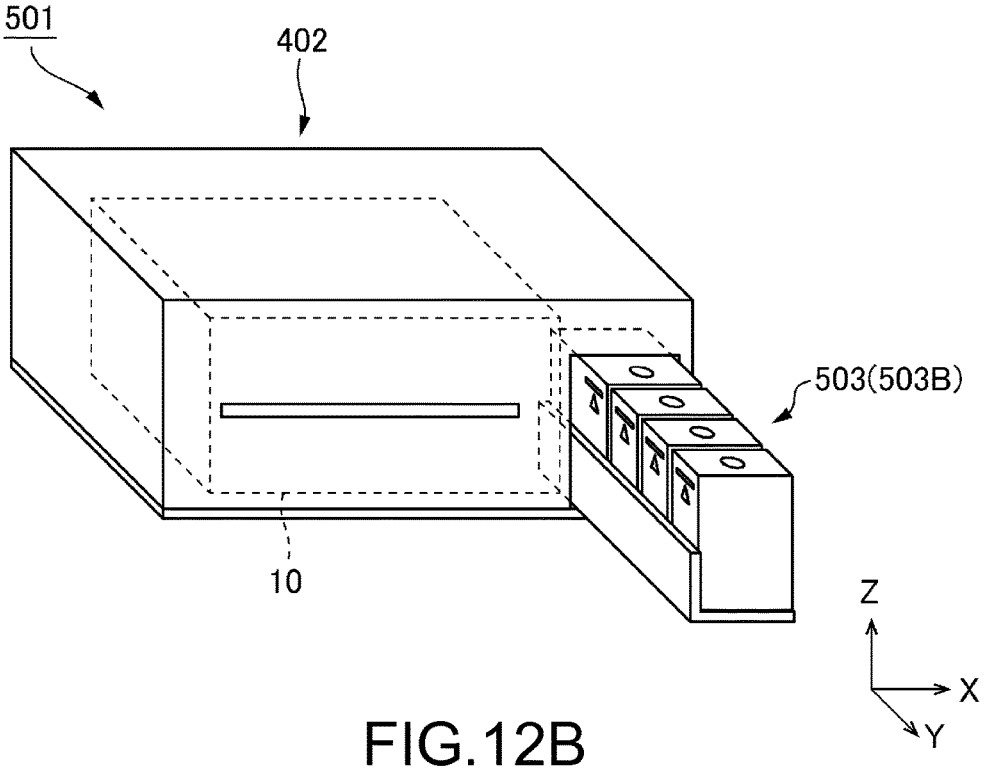

FIG. 12 includes explanatory diagrams schematically showing a liquid ejecting system of a sixth embodiment, where FIG. 12(*a*) is a perspective diagram of a tank unit, and FIG. 12(*b*) shows a state where the tank unit is pulled out forward relative to a printer. A liquid ejecting system 501 of the sixth embodiment is provided with a tank unit 503 and a printer 402. In the sixth embodiment, only the configuration of the tank unit 503 is different from that in the fifth embodiment, and the other configurations are the same as the fifth embodiment. The tank unit 503 of the sixth embodiment is provided with an under-tank case 508, and four tanks 9Bk, 9Y, 9M and 9C that are placed on the under-tank case 508. The under-tank case 508 is provided with a base portion 581 on which the four tanks 9Bk, 9Y, 9M and 9C are placed, and a side face 582 rising, in the +Z direction, from the edge in the −X direction of the base portion 581. An opening 583 through which the supply tubes 4 that are bound and a wiring (not illustrated) pass is formed in the side face 582.

The tank unit 503 can be pulled out from a first position (not illustrated) at which the tank unit 503 is housed in the printer 402, to a second position 503B on the front side (the +Y direction side) relative to the printer 402. (When the tank unit 503 is) at the second position 503B, the four tanks 9Bk, 9Y, 9M and 9C are exposed to the outside in the state of being placed on the under-tank case 508. Therefore, by pulling out the tank unit 503 to the second position 503B, it is possible to check the amount of ink in the tank unit 503, and it becomes possible to inject ink into the tank unit 503. Therefore, similarly to the fifth embodiment, operations on the tank unit 503 can be made easy. For example, it is possible to reduce the workload of the operation of checking the amount of ink in the tank unit 503 and the operation of injecting ink into the tank unit 503.

In the sixth embodiment, in each of the four tanks 9Bk, 9Y, 9M and 9C, a side face 98 (see FIG. 3) directed in the +Y direction is constituted by a case made of resin, and a side face 99 directed in the −Y direction is constituted by a film-like sheet member. As a result, when the tank unit 503 is pulled out to the second position 503B, the sheet member face is not exposed to the outside. Therefore, it is possible to reduce the risk that the tank is inadvertently damaged, causing ink leakage and the like.

Note that in the fifth and sixth embodiments, the direction in which the tank unit 403/503 slides relative to the printer 402 may be the Z axis direction, instead of the Y axis direction. In this case, it suffices to provide, in the upper face of the printer 402, an opening and an opening/closing lid that allows the tank unit 403/503 to be taken in and out. Also, the tank unit 503 of the sixth embodiment may be used as an external tank unit arranged outside of the printer as in the first to fourth embodiments.

Seventh and Eighth Embodiments

Figure 13A:
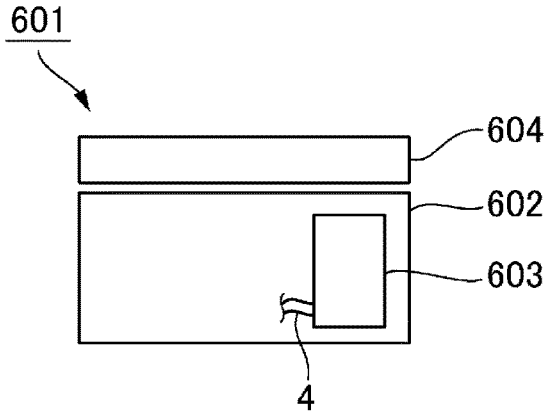
FIGS. 13A and 13B are explanatory diagrams schematically showing liquid ejecting systems according to seventh and eighth embodiments.
Figure 13B:
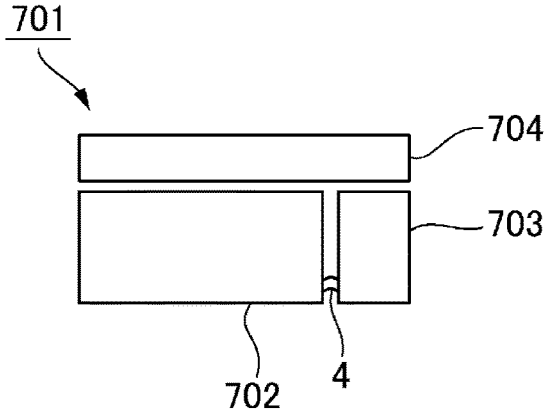

FIG. 13 includes explanatory diagrams schematically showing liquid ejecting systems of seventh and eighth embodiments, where FIG. 13(*a*) is a front view of a liquid ejecting system of the seventh embodiment, and FIG. 13(*b*) is a front view of a liquid ejecting system of the eighth embodiment. As shown in FIG. 13(*a*), a liquid ejecting system 601 of the seventh embodiment is provided with a printer 602, a tank unit 603, a supply tube 4 and a scanner unit 604. The printer 602, the tank unit 603 and the supply tube 4 are configured similarly to the liquid ejecting systems 401 and 501 of the fifth and sixth embodiments. The scanner unit 604 is placed on the upper face (face directed towards the +Z direction side) of the printer 602.

Moreover, as shown in FIG. 13(*b*), a liquid ejecting system 701 of the eighth embodiment is provided with a printer 702, a tank unit 703 arranged on the +X direction side of the printer 702, a supply tube 4 and a scanner unit 704. Similarly to the first and fourth embodiments, the tank unit 703 is engaged so as to be slidable in the Y axis direction relative to the printer 702. The scanner unit 704 is placed on the upper faces of the tank unit 703 and the printer 702 (faces directed towards the +Z direction side).

According to the layout as in the seventh and eighth embodiments, with the liquid ejecting system equipped with the scanner unit, operations on the tank unit can be made easy. For example, it is possible to enable the amount of ink in the tank unit to be checked easily.

REFERENCE SIGNS LIST

1 Liquid ejecting system
2 Printer (liquid ejecting apparatus)
3 Tank unit (liquid storing container)
3A First position
3B Second position
4 Supply tube (conduit)
5 Upper case
6 Lower case
7 Over-tank case
8 Under-tank case
9 Tank
9Bk Tank (second liquid storing portion)
9Y Tank (first liquid storing portion)
9M Tank (first liquid storing portion)
9C Tank (first liquid storing portion)
10 Mechanism unit
28 Upper limit mark
51 Front face
52 Upper face
53 Side face (second face)
54 Paper discharge unit
55 Guide rail (liquid ejecting apparatus-side engagement portion)
56 Guide rail (liquid ejecting apparatus-side engagement portion)
57 Apparatus-side opening portion (apparatus-side conduit opening portion, apparatus-side wiring opening portion)
58 Protection member
59 Slit
61 Case
63 Sheet member
65 Containing portion
68 Atmospheric air chamber
69 Communication path
71 Upper face
72 Side face
73 Side face (first face)
73A First position
73B Second position
74 Opening
75 Window portion (visual recognition portion, first visual recognition window, second visual recognition window)
76 Guide rail (liquid storing container-side engagement portion)
77 Front-side retaining portion
78 Rear-side retaining portion
79 Container-side opening portion (container-side conduit opening portion, container-side wiring opening portion)
91 Front face
92 Rear face
93 Upper face
94 Bottom face
95 Ink injection port (first liquid injection port, second liquid injection port)
96 Atmospheric air communication port
97 Supplying portion
97*a* Connection portion
98 Side face (third face)
99 Side face (fourth face)
101 Liquid ejecting system
102 Printer (liquid ejecting apparatus)
103 Tank unit (liquid storing container)
103A First position
103B Second position
176 Guide rail
183 Supported portion
185 Projection portion
187 First engagement target portion
191 Second engagement target portion
201 Liquid ejecting system
202 Printer (liquid ejecting apparatus)
203Bk Tank unit (liquid storing container)
203Y Tank unit (liquid storing container)
203M Tank unit (liquid storing container)
203C Tank unit (liquid storing container)
203A First position
203B Second position
221 Mount portion
223 Recess portion
225 First engagement portion
227 Second engagement portion
301 Liquid ejecting system
302 Printer (liquid ejecting apparatus)
303 Tank unit (liquid storing container)
303A First position
303B Second position
305 Upper case
306 Lower case
353 Side face (second face)
361 First area
362 Second area (extending portion)
363 Guide rail (liquid ejecting apparatus-side engagement portion)
373 Side face (first face)
401 Liquid ejecting system
402 Printer (liquid ejecting apparatus)
403 Tank unit (liquid storing container)
403A First position
403B Second position
405 Upper case
406 Lower case
407 Over-tank case
408 Under-tank case
451 Inner wall face (second face)
452 Front face
453 Opening
471 Upper face
472 Side face (first face)

472A First position
472B Second position
473 Side face (third face)
501 Liquid ejecting system
503 Tank unit (liquid storing container)
503B Second position
508 Under-tank case
581 Base portion
582 Side face
583 Opening
601 Liquid ejecting system
602 Printer (liquid ejecting apparatus)
603 Tank unit (liquid storing container)
604 Scanner unit
701 Liquid ejecting system
702 Printer
703 Tank unit
704 Scanner unit
P Printing medium

The invention claimed is:

1. A liquid ejecting system comprising:

a liquid ejecting apparatus that ejects a liquid and has an apparatus-side case;

a liquid storing container that contains the liquid and has a visual recognition portion through which the interior of the liquid storing container is visually recognizable;

a conduit that connects the liquid ejecting apparatus and the liquid storing container, and that supplies the liquid from the liquid storing container to the liquid ejecting apparatus, wherein the liquid storing container is slidably attached to the apparatus-side case, and is configured to slide in a slidable direction perpendicular to the −X and the +X directions, the slidable direction includes a positive direction where the liquid storing container moves from a first position to a second position and a negative direction where the liquid storing container moves from the second position to the first position, and the visual recognition portion is not exposed from the apparatus-side case and not visually recognizable in a first state where the liquid storing container is in the first position, and is exposed from the apparatus-side case and visually recognizable in a second state where the liquid storing container is in the second position.

2. The liquid ejecting system according to claim 1, wherein the apparatus-side case includes an apparatus-side wall that is directed in a +X direction, the liquid storing container includes an container-side wall that is directed in a −X direction and facing to the apparatus-side wall, the visual recognition portion is provided in the apparatus-side wall, the visual recognition portion faces the apparatus-side wall in the first state, and the visual recognition portion does not face the apparatus-side wall in the second state.

3. The liquid ejecting system according to claim 1, wherein the positive direction is a +Y direction where the liquid storing container slides from a back side of the apparatus-side case to a front side of the apparatus-side case, the negative direction is a −Y direction where the liquid storing container slides from the front side to the back side, the liquid storing container has a first liquid storing portion having a first liquid injection port, and a second liquid storing portion, the second liquid storing portion has a larger volume than the first liquid storing portion, and is positioned on the −Y direction side of the first liquid storing portion, the second liquid storing portion has a second liquid storing portion, a +Y-side face directed in the +Y direction, and a −Y-side face directed in the −Y direction, and the second liquid injection port is provided at a position closer to the +Y-side face than to the −Y-side face.

4. The liquid ejecting system according to claim 3, wherein the visual recognition portion includes a first visual recognition window through which the first liquid storing portion is visually recognizable and a second visual recognition window through which the second liquid storing portion is visually recognizable, and the second visual recognition window is provided at a position closer to the +Y-side face than to the −Y-side face of the second liquid storing portion.

5. The liquid ejecting system according to claim 1, wherein the apparatus-side case has an outer side wall that comprises the apparatus-side wall, and the liquid storing container is slidably attached to the outer side wall.

6. The liquid ejecting system according to claim 1, wherein the apparatus-side case has a bottom wall, and the liquid storing container is placed on and slidably attached to the bottom wall.

7. The liquid ejecting system according to claim 1, wherein the apparatus-side case has an outer side wall and a bottom wall, the bottom wall includes an extending portion that exists beyond the outer side wall, and the liquid storing container is placed on and slidably attached to the extending portion.

8. The liquid ejecting system according to claim 1, wherein the apparatus-side case includes an apparatus-side wall that is directed in a +X direction, the apparatus-side wall has an apparatus-side conduit opening portion extending in the slidable direction, the liquid storing container includes an container-side wall that is directed in a −X direction and facing to the apparatus-side wall, the container-side wall has a container-side conduit opening portion extending in the slidable direction, and the conduit is in communication with the interior of the liquid ejecting apparatus via the apparatus-side conduit opening portion, and is in communication with the interior of the liquid storing container via the container-side conduit opening portion.

9. The liquid ejecting system according to claim 8, wherein in a planar view of the liquid ejecting system in the −X direction, at least a portion of the apparatus-side conduit opening portion and at least a portion of the container-side conduit opening portion overlap each other both in the first and the second states.

10. The liquid ejecting system according to claim 1, wherein the liquid storing container has a residual amount detecting unit that is used to detects a residual amount of a liquid contained in the liquid storing container, and the amount of a liquid contained in the liquid storing container is observed using the visual recognition portion in the second state, and the amount of the liquid contained in the liquid storing container is detected using the residual amount detecting unit in the first state.

11. The liquid ejecting system according to claim 10, further comprising:

a wire that is connected to the residual amount detecting unit, wherein the apparatus-side case includes an apparatus-side wall that is directed in a +X direction, the apparatus-side wall has an apparatus-side wiring opening portion that extends in the slidable direction, the liquid storing container includes an container-side wall that is directed in a −X direction and facing to the apparatus-side wall, the container-side wall has a container-side wiring opening portion that extends in the slidable direction, and the wire is connected to the interior of the liquid ejecting apparatus via the apparatus-side wiring opening portion, and is connected to the interior of the liquid storing container via the container-side wiring opening portion.

12. The liquid ejecting system according to claim 11, wherein in a planar view of the liquid ejecting system in the −X direction, at least a portion of the apparatus-side wiring opening portion and at least a portion of the container-side wiring opening portion overlap each other both in the first and the second states.

13. The liquid ejecting system according to claim 12, wherein the positive direction is a +Y direction where the liquid storing container slides from a back side to a front side of the liquid ejecting apparatus, the negative direction is a −Y direction where the liquid storing container slides from the front side the back side, the liquid storing container has a first liquid storing portion having a first liquid injection port, and a second liquid storing portion, the second liquid storing portion has a larger volume than the first liquid storing portion, and is positioned on the −Y direction side of the first liquid storing portion, the second liquid storing portion has a second liquid storing portion, a +Y side face directed in the +Y direction, and a −Y side face directed in the −Y direction, and the second liquid injection port is provided at a position closer to the +Y side face than to the −Y side face.

14. The liquid ejecting system according to claim 1, wherein the liquid ejecting apparatus has an accommodating portion that accommodates the liquid storing container inside the case.

15. The liquid ejecting system according to claim 1, wherein the visual recognition portion includes a first visual recognition window through which the first liquid storing portion is visually recognizable and a second visual recognition window through which the second liquid storing portion is visually recognizable, and the second visual recognition window is provided at a position closer to the +Y-side face than to the −Y-side face of the second liquid storing portion.

* * * * *